US007597427B2

(12) United States Patent
Sugahara

(10) Patent No.: US 7,597,427 B2
(45) Date of Patent: Oct. 6, 2009

(54) LIQUID CHANNEL STRUCTURE AND LIQUID-DROPLET JETTING APPARATUS

(75) Inventor: Hiroto Sugahara, Aichi-ken (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 379 days.

(21) Appl. No.: 11/729,370

(22) Filed: Mar. 28, 2007

(65) Prior Publication Data

US 2007/0229603 A1 Oct. 4, 2007

(30) Foreign Application Priority Data

Mar. 31, 2006 (JP) ..... 2006-097265

(51) Int. Cl.
*B41J 2/045* (2006.01)

(52) U.S. Cl. ..... 347/68; 347/65; 347/92

(58) Field of Classification Search ..... 347/65, 347/68, 70–72, 92–94, 67
See application file for complete search history.

(56) References Cited

U.S. PATENT DOCUMENTS 6,290,340 B1 * 9/2001 Kitahara et al. ..... 347/70
6,431,688 B1 * 8/2002 Shin et al. ..... 347/65
6,846,069 B2 1/2005 Ito et al.
7,503,642 B2 * 3/2009 Hibi ..... 347/68
2006/0044360 A1 3/2006 Sugahara

FOREIGN PATENT DOCUMENTS

JP 8309971 11/1996
JP 2003-326706 11/2003

* cited by examiner

*Primary Examiner*—Juanita D Stephens
(74) *Attorney, Agent, or Firm*—Reed Smith LLP

(57) ABSTRACT

An ink channel in a channel unit includes a pressure chamber and a throttle channel in which ink flows along different planes and a communication hole which communicates the pressure chamber and the throttle channel. A center line of the communication hole deviates from a center line of the pressure chamber in a width direction of the pressure chamber, and also deviates from a center line of the throttle channel in a width direction of the throttle channel. Consequently, a swirling flow is generated in connection portions at which the pressure chamber and the throttle channel are connected to the communication hole, thereby effectively preventing bubbles from staying.

16 Claims, 19 Drawing Sheets

LIQUID CHANNEL STRUCTURE AND LIQUID-DROPLET JETTING APPARATUS

CROSS REFERENCE TO RELATED APPLICATION

The present application claims priority from Japanese Patent Application No. 2006-097265, filed on Mar. 31, 2006, the disclosure of which is incorporated herein by reference in its entirety.

BACKGROUND OF THE INVENTION

1. Field of the Invention

The present invention relates to a liquid channel structure and a liquid-droplet jetting apparatus which jets liquid droplets.

2. Description of the Related Art

In an ink-jet head which jets droplets of ink from a nozzle, if an ink channel has a bent portion, bubbles easily stay or remain in the bent portion. Bubbles are not easily discharged even by purging which forcibly discharges the ink from the nozzle. The bubbles existing in the ink channel hinder the application of a sufficient jetting pressure to the ink in the ink channel and will be a cause of non-discharge or discharge failure of the ink. Therefore, there has conventionally been proposed an ink-jet head which is structured to prevent the bubbles from staying in the bent portion of the ink channel.

For example, U.S. Pat. No. 6,846,069 (corresponding to Japanese Patent Application Laid-open No. 2003-326706) discloses an ink-jet head with the following structure. This ink-jet head has ink channels each extending from a common ink chamber to a nozzle via a pressure chamber. Between the common ink chamber and the pressure chamber, a throttled portion is provided and the ink flows in the throttled portion and the pressure chamber in mutually opposite directions. Further, the throttled portion and the pressure chamber communicate with each other via an ink supply hole. That is, the ink channel is folded back at the ink supply hole between the throttled portion and the pressure chamber. Here, the ink supply hole extends in a direction inclined to the flow direction of the ink. Therefore, the ink in the ink supply hole flows into an end portion of the pressure chamber toward a wall surface of the pressure chamber, and consequently, bubbles are prevented from staying in the bent portion connecting the pressure chamber and the ink supply hole.

According to the ink channel structure of the abovementioned U.S. Pat. No. 6,846,069, although the bubbles staying in the bent portion can be reduced to some extent, the preventing function is not sufficient. Therefore, a channel structure capable of more surely preventing the bubbles from staying is being demanded.

SUMMARY OF THE INVENTION

It is an object of the present invention to provide a liquid channel structure and a liquid-droplet jetting apparatus capable of more surely preventing bubbles from staying in a channel. It should be noted that parenthesized reference numerals assigned to elements below are only examples of the elements and are not intended to limit the elements.

According to a first aspect of the present invention, there is provided a liquid channel structure including: a first channel (16) which extends along a first plane (10) and in which liquid flows; a second channel (20) which extends along a second plane (12) different from the first plane and in which the liquid flows; and a communication channel (18) which communicates the first channel at an end portion thereof and the second channel at an end portion thereof, wherein a center line (C3) of the communication channel deviates from a center line (C1 or C2) of at least one of the first and the second channels in a width direction of one of the first and second channels; and a channel area (A3) of the communication channel is larger than a channel area (A1) of the first channel at the end portion (16*d*) thereof and a channel area (A2) of the second channel at an end portion (20*d*) thereof.

According to the liquid channel structure of the present invention, the channel area (A3) of the communication channel, the channel area (A1) of the first channel at the end portion (16*d*) thereof on a side of the communication channel, and the channel area (A2) of the second channel at the end portion (20*d*) thereof on a side of the communication channel satisfy the above-described relation, and the center line (C3) of the communication channel which communicates the first channel and the second channel deviates from the center line (C1 or C2) of at least one of the first channel and the second channel in the width direction of one of the first and second channels. Therefore, a swirling flow is generated at a connection portion (16*a*, 20*a*) (folded portion) at which the first channel or the second channel is connected to the communication channel. This swirling flow can prevent bubbles from staying in the connection portion. In the present invention, "channel area" means an area of a cross section, of the liquid channel, orthogonal to a flow direction of the liquid. "Center line" means a line passing through a center of the cross section of the liquid channel and extending in a direction in which the liquid channel extends.

In the liquid channel structure of the present invention, the center line (C3) of the communication channel (18) may deviate from both of the first channel (16) and the second channel (20) in the width direction of the both channels. In this case, it is possible to prevent bubbles from staying both in the connection portion (16*a*) at which the first channel is connected to the communication channel and in the connection portion (20*a*) at which the second channel is connected to the communication channel.

In the liquid channel structure of the present invention, the channel area (A3) of the communication channel (18) may be larger than a channel area (A1), of one of the first and second channels (16 or 20) which is positioned on a downstream in a flow direction of the liquid, at the end portion thereof. In a case where the channel area of the upstream side channel is larger than the channel area of the downstream side channel, if large bubbles flow in, the bubbles do not easily flow to the downstream and easily stay in the connection portion of the two channels. However, in the case of the present invention, since the swirling flow is generated in this connection portion (16*a*), it is possible to surely prevent the bubbles from staying.

In the liquid channel structure of the present invention, a connection portion (16*a* or 20*a*) at which one of the first and second channels (16 or 20) is connected to the communication channel (18) may be bent toward a center (C3) of the communication channel (18). In this case, since a swirling flow is surely generated in the connection portion, it is possible to more surely prevent bubbles from staying.

In the liquid channel structure of the present invention, the liquid may flow in the first channel (16) and the second channel (20) in mutually opposite directions, and the center line (C3) of the communication channel (18) may be positioned between the center line (C1) of the first channel and the center line (C2) of the second channel. In this case, since the liquid flows in the first channel and the second channel in mutually opposite directions, the apparatus (1) can be made compact. Furthermore, since the center line of the communication channel is positioned between the center line of the first channel and the center line of the second channel, the liquid flows smoothly and thus bubbles are prevented from staying.

In the liquid channel structure of the present invention, the communication channel (18) may have a cylindrical form, the end portion (16*d*) of the first channel (16) may be connected to one end portion (18*a*) of the communication channel; the end portion (20*d*) of the second channel (20) may be connected to the other end portion (18*b*) of the communication channel; and a sidewall (16*c*) of the first channel is curved, at the end portion of the first channel, along a sidewall (18*c*) of the communication channel, and a sidewall (20*c*) of the second channel is curved, at the one end portion of the second channel, along the sidewall of the communication channel. In this case, the liquid flowing in one of the first channel and the second channel smoothly flows into the communication channel. Moreover, the liquid flowing in the communication channel flows smoothly into the other of the first channel and the second channel. Therefore, a swirling flow is easily generated.

In the liquid channel structure of the present invention, the first plane (10) may be parallel to the second plane (12).

According to a second aspect of the present invention, there is provided a liquid-droplet jetting apparatus (1) which jets a liquid droplet of a liquid from a nozzle (25), including: a channel unit (5) which has a liquid channel (26) communicating with the nozzle; and a jetting pressure applying mechanism (6) which applies a jetting pressure to the liquid in the liquid channel, wherein the liquid channel includes a first channel (16) which extends along a first plane (10) and in which the liquid flows a second channel (20) which extends along a second plane (12) different from the first plane and in which the liquid flows and a communication channel (18) which communicates the first channel at an end portion thereof and the second channel at an end portion thereof; a center line (C3) of the communication channel deviates from a center line (C1 or C2) of at least one of the first and second channels in a width direction of one of the first and second channels; and a channel area (A3) of the communication channel is larger than a channel area (A1) of the first channel at the end portion (16*d*) thereof and a channel area (A2) of the second channel at the end portion (20*d*) thereof.

According to the liquid-droplet jetting apparatus of the present invention, the channel area (A3) of the communication channel, the channel area (A1) of the first channel at the end portion (16*d*) thereof and the channel area (A2) of the second channel at the end portion (20*d*) thereof satisfy the above-described relation, and the center line (C3) of the communication channel which communicates the first and second channels deviates from the center line (C1 or C2) of at least one channel out of the first channel and the second channel in the width direction of this channel. Therefore, since a swirling flow is generated in a connection portion (16*a* or 20*a*) (folded portion) at which the first channel (16) or the second channel (20) is connected to the communication channel (18), it is possible to prevent bubbles from staying in the connection portion and to surely discharge the bubbles from the nozzle.

In the liquid-droplet jetting apparatus (1) of the present invention, the liquid may flow in the first channel (16) and the second channel (20) in mutually opposite directions, and the center line (C3) of the communication channel (18) may be positioned between the center line (C1) of the first channel and the center line (C2) of the second channel. In this case, since the liquid flows in the first channel and the second channel in mutually opposite directions, the apparatus (1) can be made compact. Furthermore, since the center line of the communication channel is positioned between the center line of the first channel and the center line of the second channel, the liquid flows smoothly and bubbles are prevented from staying.

In the liquid-droplet jetting apparatus (1) of the present invention, the channel unit (5) may have a structure in which a plurality of stacked plates each having a part of the liquid channel (26) formed therein; the first channel (16) may be formed in a first plate (10) included in the plates, and the second channel (20) may be formed in a second plate (12) included in the plates and different from the first plate; and the communication channel (18) may be formed in a third plate (11) included in the plates and different from the first plate and the second plate, and the third plate may be arranged between the first plate and the second plate. In this case, since the first channel and the second channel formed in the first plate and the second plate respectively communicate with each other via the communication channel formed in the third plate arranged between the first plate and the second plate, the liquid channel is folded in the connection portion at which the first channel or the second channel is connected to the communication channel. According to the structure of the present invention, since a swirling flow is generated in the connection portion at which the first channel or the second channel is connected to the communication channel, it is possible to prevent bubbles from staying.

In the liquid-droplet jetting apparatus (1) of the present invention, a connection portion (16*a* or 20*a*) at which one of the first and second channels (16 or 20) is connected to the communication channel (18), may be bent toward a center (C3) of the communication channel; a through hole (16*b* or 20*b*) defining a portion other than the connection portion of one of the first and second channels may be formed in one of the first plate (10) and the second plate (12); and the connection portion of one of the first and second channels may be defined by a recess formed in a surface of one of the first and second plates, the surface being on a side of the third plate (11). In this case, in the first channel or the second channel, a main channel (16*b* or 20*b*) (the portion other than the connection portion connected to the communication channel) is defined by the through hole and the connection portion bent toward the center of the communication channel is defined by the recess formed in the surface of one of the first and second plates on a side of the third plate in which the communication channel is formed, and therefore, a swirling flow is surely generated in the connection portion.

In the liquid-droplet jetting apparatus (1) of the present invention, the third plate (11) may further include a plurality of communication channel plates (40, 41, 42) stacked on each other in a stacking direction, communication holes (50, 51, and 52) each forming a part of the communication channel may be formed in the communication channel plates respectively; each of the communication holes (50) may have a substantially circular center hole (50*a*) and a notch (50*b*) positioned outside the center hole; and the communication channel may include an overlap area (50*a*, 51*a*, 52*a*) formed of a center hole of a communication channel plate among the communication channel plates overlapping with a center hole in another communication channel plate among the communication channel plates, and a spiral area (50*b*, 51*b*, 52*b*) formed of a notch in the communication channel plate partly overlapping, in a circumferential direction of the center hole in the communication channel plate, with a notch in another communication channel plate among the communication channel plates, which is adjacent in the stacking direction. In this case, since the center holes formed in the communication holes each forming a part of the communication channel substantially overlap with one another, the mainstream of the liquid flows smoothly in the communication channel. On the other hand, since the notches formed in the communication holes respectively are arranged spirally while partly overlapping with one another, a tributary stream of the liquid becomes a swirling flow in the communication channel and thus it is possible to surely prevent bubbles from staying in the communication channel.

In the liquid-droplet jetting apparatus (1) of the present invention, a mainstream of the liquid in the communication channel (18) may flow in the overlapping area (50*a*, 51*a*, 52*a*), and a tributary stream of the liquid may flow in the spiral area (50*b*, 51*b*, 52*b*). In this case, since the mainstream of the liquid flows smoothly and the tributary stream of the liquid becomes a swirling flow, it is possible to surely prevent bubbles from staying in the communication channel.

In the liquid-droplet jetting apparatus (1) of the present invention, the liquid channel (26) may include a common liquid chamber (23); a pressure chamber (16) as the first channel which communicates with the nozzle (25), the jetting pressure being applied to the liquid in the pressure chamber by the jetting pressure applying mechanism (6); a throttle channel (20) as the second channel which communicates with the common liquid chamber and has a channel area smaller than a channel area of the pressure chamber; and the communication channel (18) which communicates the pressure chamber and the throttle channel; and the liquid channel may be folded back at the communication channel between the throttle channel and the pressure chamber, and a flow direction in which the liquid flows in the throttle channel may be substantially opposite to a flow direction in which the liquid flows in the pressure chamber. In this case, the jetting pressure applying mechanism applies the jetting pressure to the liquid in the pressure chamber supplied from the common liquid chamber to the pressure chamber via the throttle channel, and consequently, droplets of the liquid are jetted from the nozzle communicating with the pressure chamber. Here, the throttle channel is formed to prevent a pressure wave generated in the pressure chamber from escaping to the common liquid channel, and the channel area of the throttle channel is smaller than the channel area of the pressure chamber. Further, to enhance the effect of the throttle channel, it is desirable that the throttle channel is as long as possible, but an increase in size of the apparatus due to the increase in the length of the throttle channel is not desirable. Therefore, it is preferable to fold the throttle channel and the pressure chamber, thereby making the channel structure compact. From this viewpoint, in the liquid-droplet jetting apparatus of the present invention, the liquid channel is folded back at the communication channel between the pressure chamber as the first channel and the throttle channel as the second channel, and the direction in which the liquid flows in the throttle channel is substantially opposite to the direction in which the liquid flows in the pressure chamber. Since the liquid channel having such a folded structure is folded at the connection portions (16*a*, 20*a*) at which the pressure chamber and the throttle channel are connected to the communication channel, bubbles easily stay in such connection portions. According to the present invention, since a swirling flow is generated in the connection portions of the channels, bubbles are prevented from staying.

In the liquid-droplet jetting apparatus (1) of the present invention, the communication channel (18) may have a cylindrical form, the end portion (16*d*) of the pressure chamber (16) may be connected to one end portion (18*a*) of the communication channel; the end portion (20*d*) of the throttle channel (20) may be connected to the other end portion (18*b*) of the communication channel; and a sidewall (16*c*) of the pressure chamber is curved, at the end portion of the pressure chamber, along a sidewall (18*c*) of the communication channel, and a sidewall (20*c*) of the throttle channel is curved, at the end portion (20*d*) of the throttle channel, along the sidewall of the communication channel. In this case, the liquid flowing in the throttle channel flows smoothly into the communication channel. Further, the liquid flowing in the communication channel flows smoothly into the pressure chamber. Therefore, a swirling flow is easily generated.

In the liquid-droplet jetting apparatus (1) of the present invention, the first plane (10) may be parallel to the second plane (12).

DETAILED DESCRIPTION OF THE PREFERRED EMBODIMENTS

Next, an embodiment of the present invention will be explained. This embodiment is an example where the present invention is applied to an ink-jet head which jets droplets of ink to a recording paper.

Figure 1:
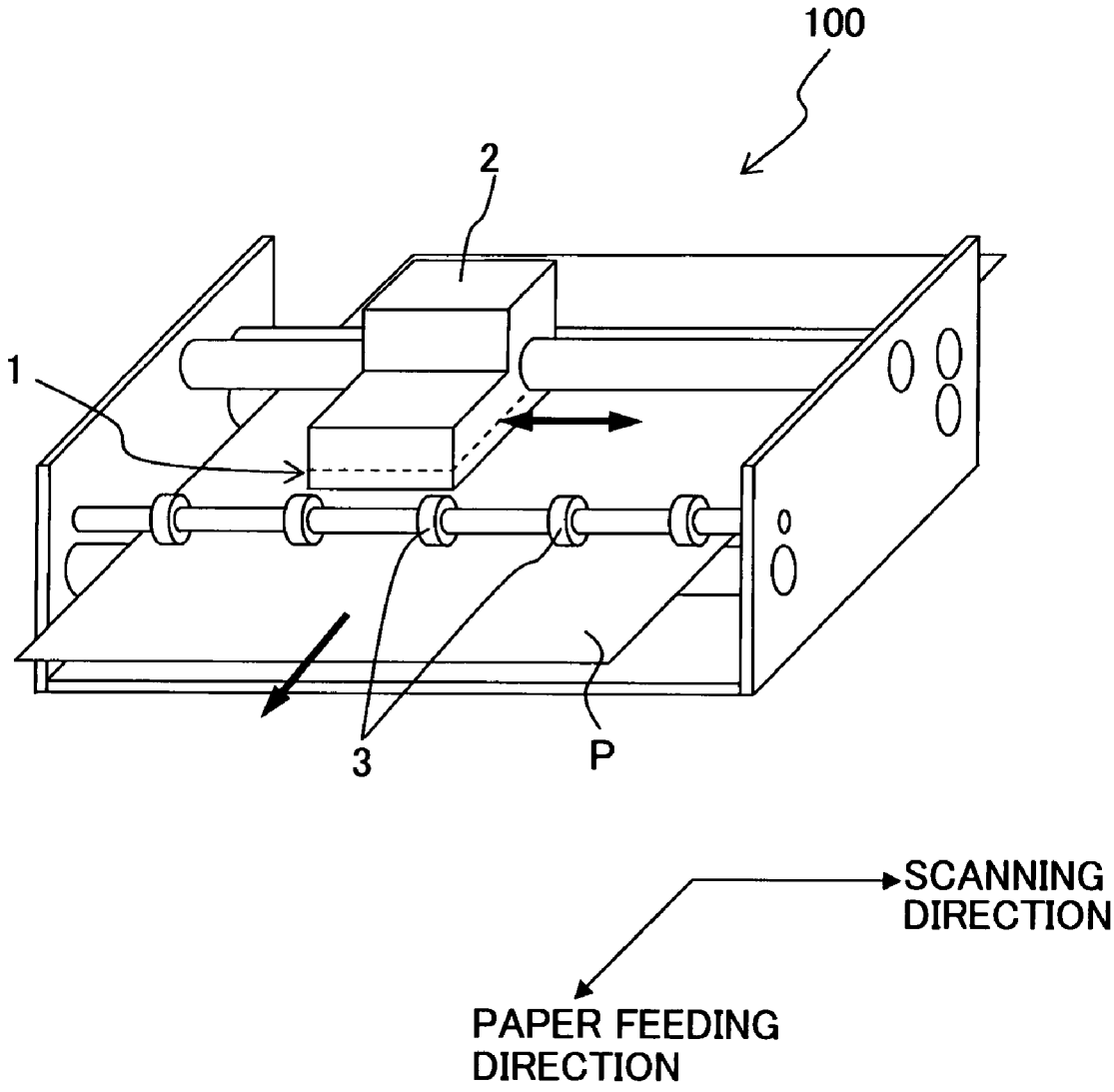
FIG. 1 is a schematic structural view of an ink-jet printer according to an embodiment of the present invention.

An ink-jet printer 100 including an ink-jet head 1 will be briefly explained. As shown in FIG. 1, the ink-jet printer 100 includes: a carriage 2 movable in a right and left direction in FIG. 1, the serial-type ink-jet head 1 (liquid-droplet jetting apparatus) which is provided in the carriage 2 to jet ink to a recording paper P; a feeding roller 3 which feeds the recording paper P in a forward direction in FIG. 1; and so on. The ink-jet head 1 moves integrally with the carriage 2 in the right and left direction (scanning direction). The ink-jet head 1 jets the ink to the recording paper P from nozzles 25 (see FIG. 2 to FIG. 4) disposed on a lower surface thereof to record desired characters, images, and the like on the recording paper P. Further, the recording paper P on which the images and the like are recorded by the ink-jet head 1 is discharged in the forward direction (paper feeding direction) by the feeding roller 3.

Figure 2:
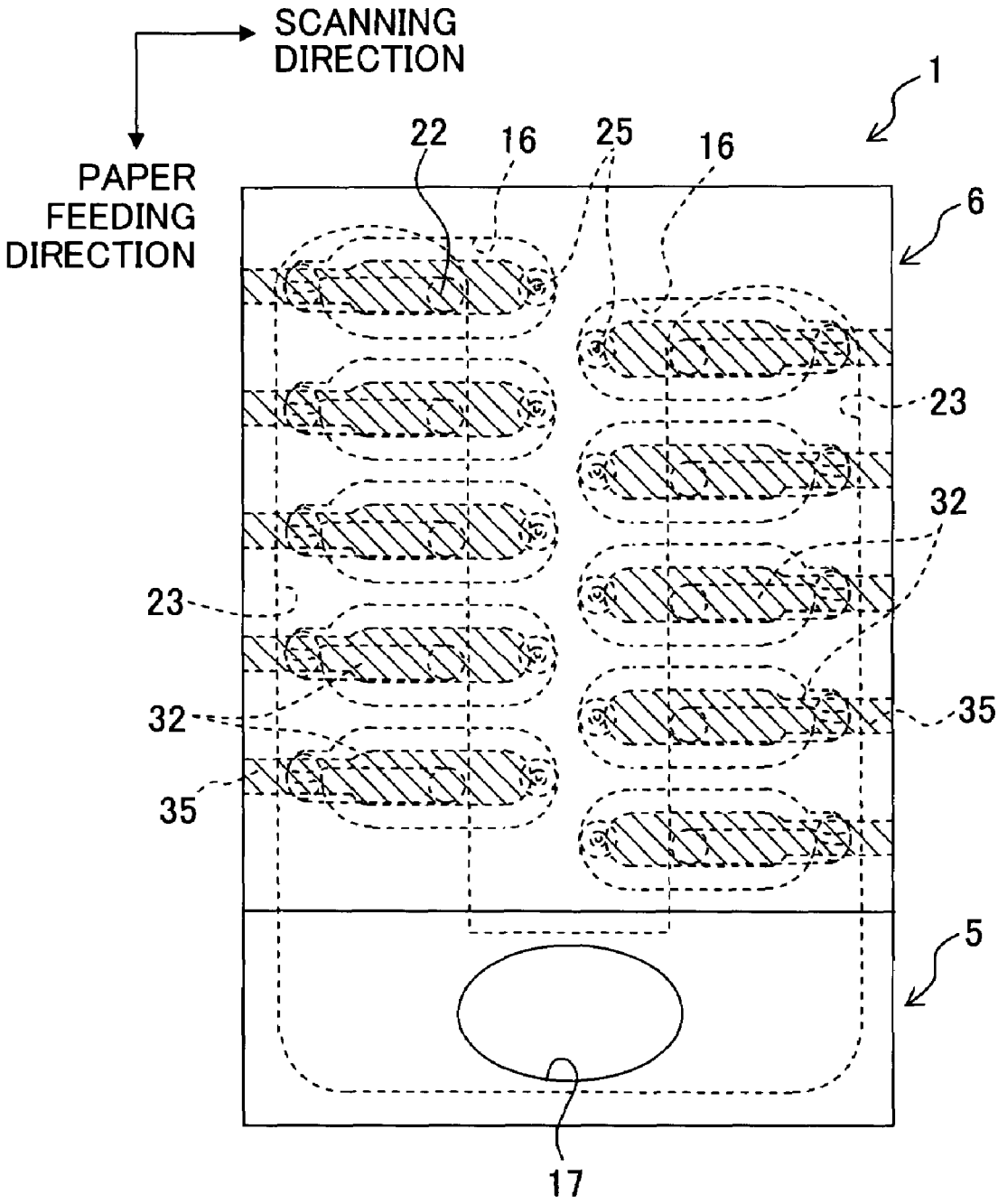
FIG. 2 is a plan view of an ink-jet head.
Figure 3:
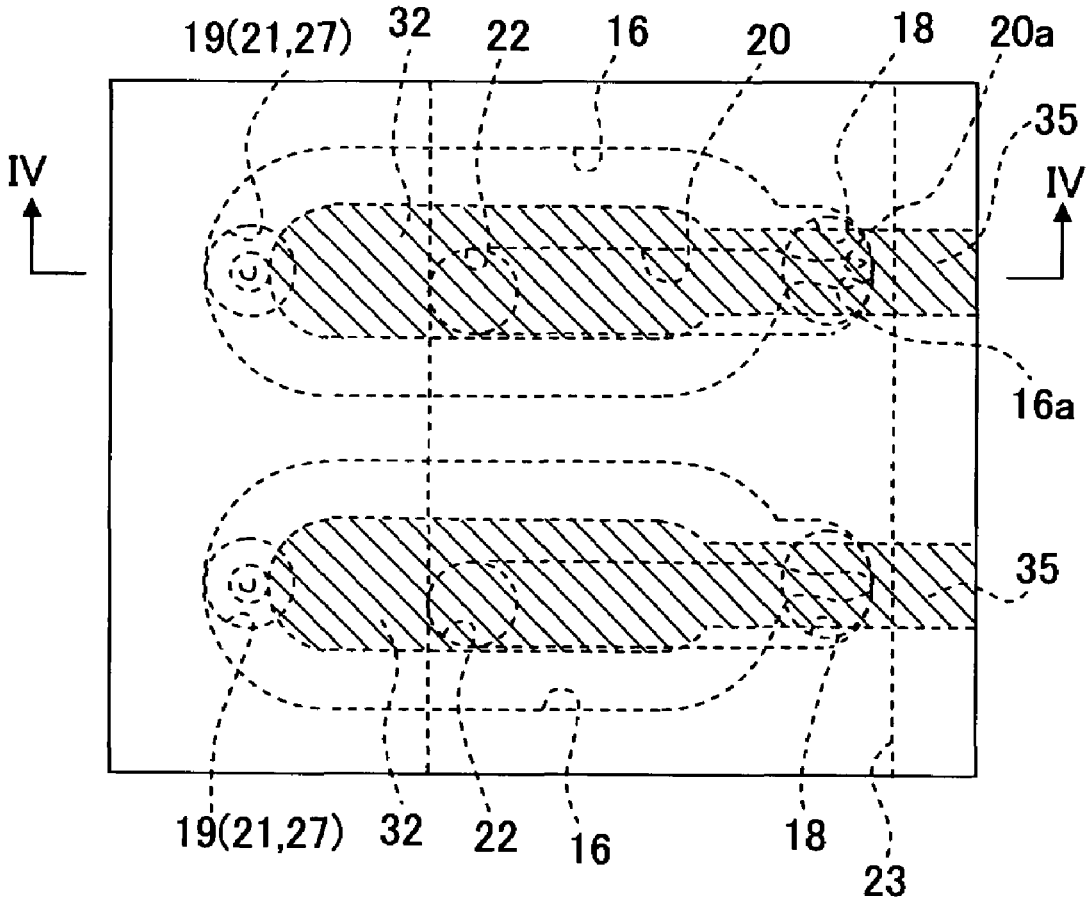
FIG. 3 is a partial enlarged view of FIG. 2.
Figure 4:
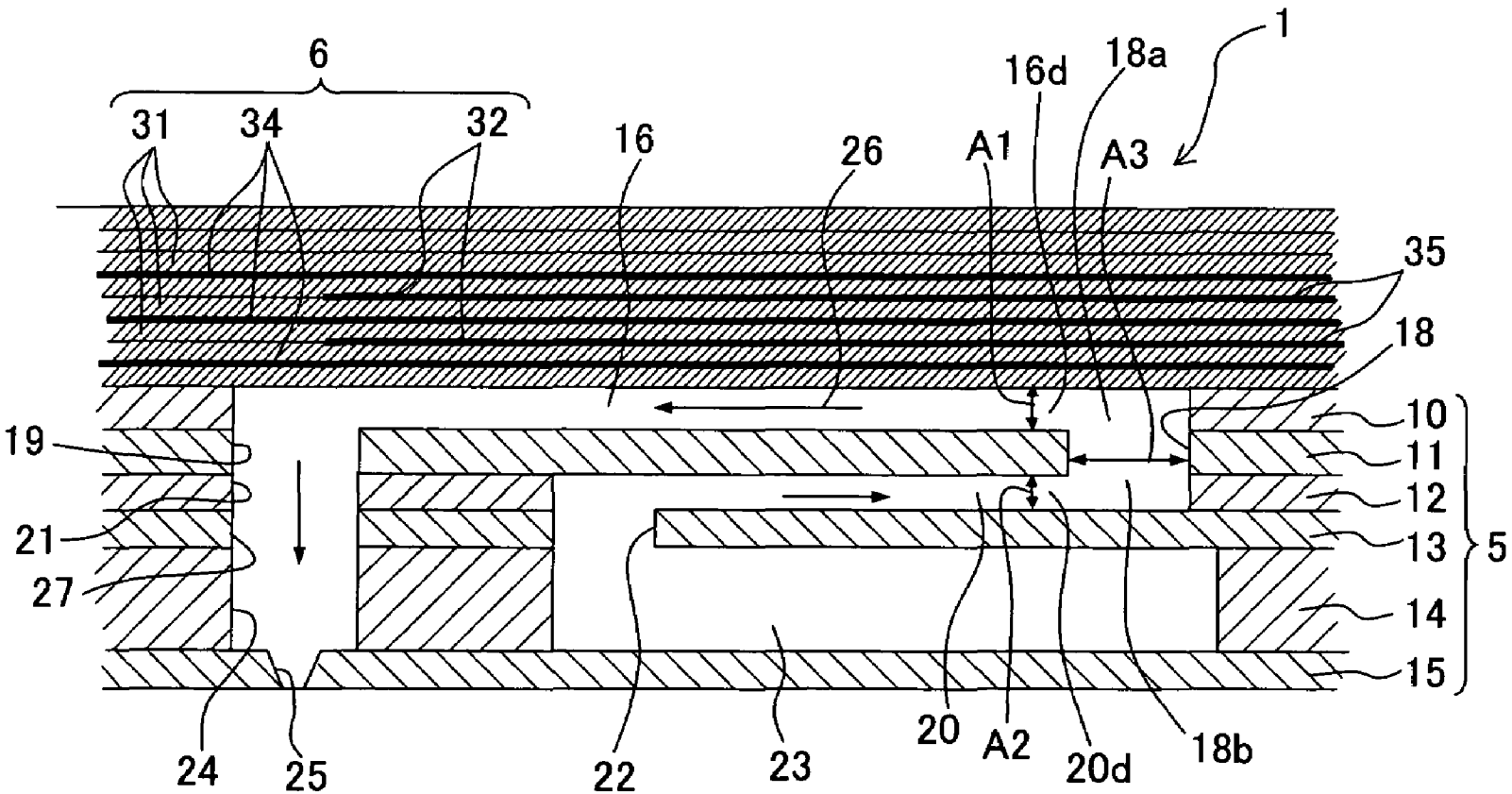
FIG. 4 is a cross-sectional view taken along line IV-IV in FIG. 3.

Next, the ink-jet head 1 will be explained. As shown in FIG. 2 to FIG. 4, the ink-jet head 1 includes: a channel unit 5 in which ink channels 26 (liquid channels) including the nozzles 25 are formed; and a piezoelectric actuator 6 (jetting pressure applying mechanism) which is disposed on an upper surface of the channel unit 5 to apply a jetting pressure to the ink in the ink channels 26.

First, the channel unit 5 will be explained. As shown in FIG. 2 to FIG. 4, the channel unit 5 includes a cavity plate 10, a base plate 11, a throttle plate 12, a supply plate 13, a manifold plate 14, and a nozzle plate 15. These six plates 10 to 15 are bonded in a stacked state. Among these six plates 10 to 15, the cavity plate 10, the base plate 11, the throttle plate 12, the supply plate 13, and the manifold plate 14 are made of metal such as stainless steel or the like. In these five plates 10 to 14, ink channels including pressure chambers 16 (first channels), manifolds, and so on (to be described later) are formed by etching. Further, the nozzle plate 15 is formed of, for example, a synthetic polymeric resin material such as polyimide and is bonded on a lower surface of the manifold plate 14. Alternatively, this nozzle plate 15 may also be formed of a metal material such as stainless steel or the like similarly to the five plates 10 to 14.

As shown in FIG. 2 to FIG. 4, through holes are formed in the uppermost cavity plate 10 among the six plates 10 to 15, and the through holes are arranged as the pressure chambers 16 in two rows, the pressure chambers 16 in each of the rows being arranged in the paper feeding direction along a plane. These pressure chambers 16 are covered by the piezoelectric actuator 6 (to be described later) and the base plate 11 from upper and lower sides. Each of the pressure chambers 16 has a substantially elliptical shape which is long in the scanning direction (right and left direction in FIG. 2) in a plan view. In the cavity plate 10, an ink inlet port 17 which is connected to an ink tank (not shown) to lead ink in the ink tank into the channel unit 5 is also formed in the cavity plate 10.

As shown in FIG. 3 and FIG. 4, in the base plate 11, communication holes 18, 19 which are substantially circular as viewed from the upper surface of the base plate 11 are formed at positions overlapping with both end portions of the pressure chambers 16, respectively, in a plan view. Further, in the throttle plate 12, throttle channels 20 (second channels), which extend from positions overlapping with the communication holes 18 (communication channels) in parallel to a longitudinal direction of the pressure chambers 16, and communication holes 21 overlapping with the communication holes 19 are formed in areas overlapping with the pressure chambers 16. Further, in the supply plate 13, ink supply holes 22 overlapping with end portions, of the throttle channels 20, on a side opposite to the communication holes 18 and communication holes 27 overlapping with the communication holes 19, 21 are formed.

In the manifold plate 14, two manifolds 23 (common liquid chambers) extending in the arrangement direction of the pressure chambers 16 (paper feeding direction) are formed to partly overlap with the two rows of the pressure chambers 16 respectively in a plan view. In a plan view, the manifolds 23 also overlap with the ink supply holes 22 corresponding to the pressure chambers 16 respectively. The manifolds 23 communicate with the pressure chambers 16 via the ink supply holes 22 and the throttle channels 20 communicating with the ink supply holes 22. The two manifolds 23 also communicate with the ink inlet port 17 formed in the cavity plate 10. Via this ink inlet port 17, the ink is lead into the two manifolds 23 from the ink tank (not shown), and the ink is distributed to the pressure chambers 16 from the manifolds 23. In the manifold plates 14, communication holes 24 overlapping with the communication holes 19, 21, 27 are also formed.

Further, in the nozzle plate 15, the nozzles 25 overlapping with the communication holes 19, 21, 27, 24 in a plan view are formed.

As shown in FIG. 4, the manifolds 23 communicate with the pressure chambers 16 via the ink supply holes 22, the throttle channels 20, and the communication holes 18. Further, the pressure chambers 16 communicate with the nozzles 25 via the communication holes 19, 21, 27, 24. In this manner, in the channel unit 5, the ink channels 26 extending from the manifolds 23 to the nozzles 25 via the pressure chambers 16 are formed.

Here, a jetting pressure is applied to the ink in the pressure chamber 16 by the piezoelectric actuator (to be described later), and as a result, droplets of the ink are jetted from the nozzle 25 communicating with this pressure chamber 16. The throttle channels 20 are formed to prevent a pressure wave generated in the pressure chambers 16 from escaping to the manifolds 23. This enables the effective application of the jetting pressure (jetting energy) to the ink. As shown in FIG. 4, a channel area A2 of the throttle channel 20 at an end portion 20*d* at which the throttle channel 20 communicates with the communication hole 18 (area of a cross section orthogonal to a flow direction of the ink in the throttle channel 20) is smaller than a channel area A1 of the pressure chamber 16 at an end portion 16*d* at which the pressure chamber 16 communicates with the communication hole 18 (area of a cross section orthogonal to a flow direction of the ink in the pressure chamber 16).

Incidentally, the longer the throttle channel 20 is, the higher the effect of preventing the propagation of the pressure wave to the manifold 23 is, and therefore, the more efficiently a desired pressure can be applied to the ink in the pressure chamber 16. However, an increase in size of the channel unit 5 (the ink-jet head 1) in accordance with the increase in the length of the throttle channel 20 is not preferable. Therefore, in this embodiment, each of the ink channels 26 of the ink-jet head 1 has the following structure in order to secure a sufficient length of the throttle channel 20 without increasing the size of the channel unit 5.

The pressure chambers 16 (first channels) and the throttle channels 20 (second channels) are formed in different plates (the cavity plate 10 (first plate) and the throttle plate 12 (second plate)) respectively. In the pressure chambers 16 and the throttle channels 20, the ink flows along two different plate surfaces (first and second planes) respectively. Further, the communication holes 18 (communication channels) which communicate the pressure chambers 16 and the throttle channels 20 are formed in the base plate 11 (third plate) between the cavity plate 10 and the throttle plate 12.

As shown in FIG. 3 and FIG. 4, the throttle channels 20 are arranged to overlap with the pressure chambers 16 in a plan view, and the ink flows in the throttle channels 20 in a direction substantially opposite to that in the pressure chambers 16. That is, the pressure chambers 16 (first channels) and the throttle channels 20 (second channels) are folded in the opposite directions at the communication holes 18 (communication channels) which communicate the pressure chambers 16 and the throttle channels 20. Accordingly, the ink channels 26 are compactly arranged in the channel unit 5, and therefore, the channel unit 5 can be made compact.

In this embodiment, as shown in FIG. 4, a channel area A3 of the communication hole 18 which communicates the pressure chamber 16 and the throttle channel 20 (area of a cross section orthogonal to the flow direction of the ink in the communication hole 18) is larger than both of the channel area A1 of the pressure chamber 16 at the end portion 16*d* thereof and the channel area A2 of the throttle channel 20 at the end portion 20*d* thereof.

However, the ink channel 26 with such a structure is folded at a connection portion 16*a* at which the pressure chamber 16 is connected to the communication hole 18 and a connection portion 20*a* at which the throttle channel 20 is connected to the communication hole 18. Therefore, in these connection portions 16*a*, 20*a*, there exist portions where the flow velocity of the ink locally becomes lower. Consequently, bubbles flowing from an upstream of the ink channel 26 easily stay in the folded portion. Moreover, the channel area A3 of the communication hole 18 is larger than the channel area A1 of the pressure chamber 16 which is positioned on a downstream side in the flow direction of the communication hole 18. Therefore, large bubbles, if flowing to this portion, are difficult to flow from the communication hole 18 to the pressure chamber 16 and there is a risk that the bubbles might stay in an entrance of the pressure chamber 16. In such a state, it is necessary to repeatedly perform purging to forcibly discharge the ink from the nozzle 25, and a large amount of the ink is discharged by the purging.

Figure 5:
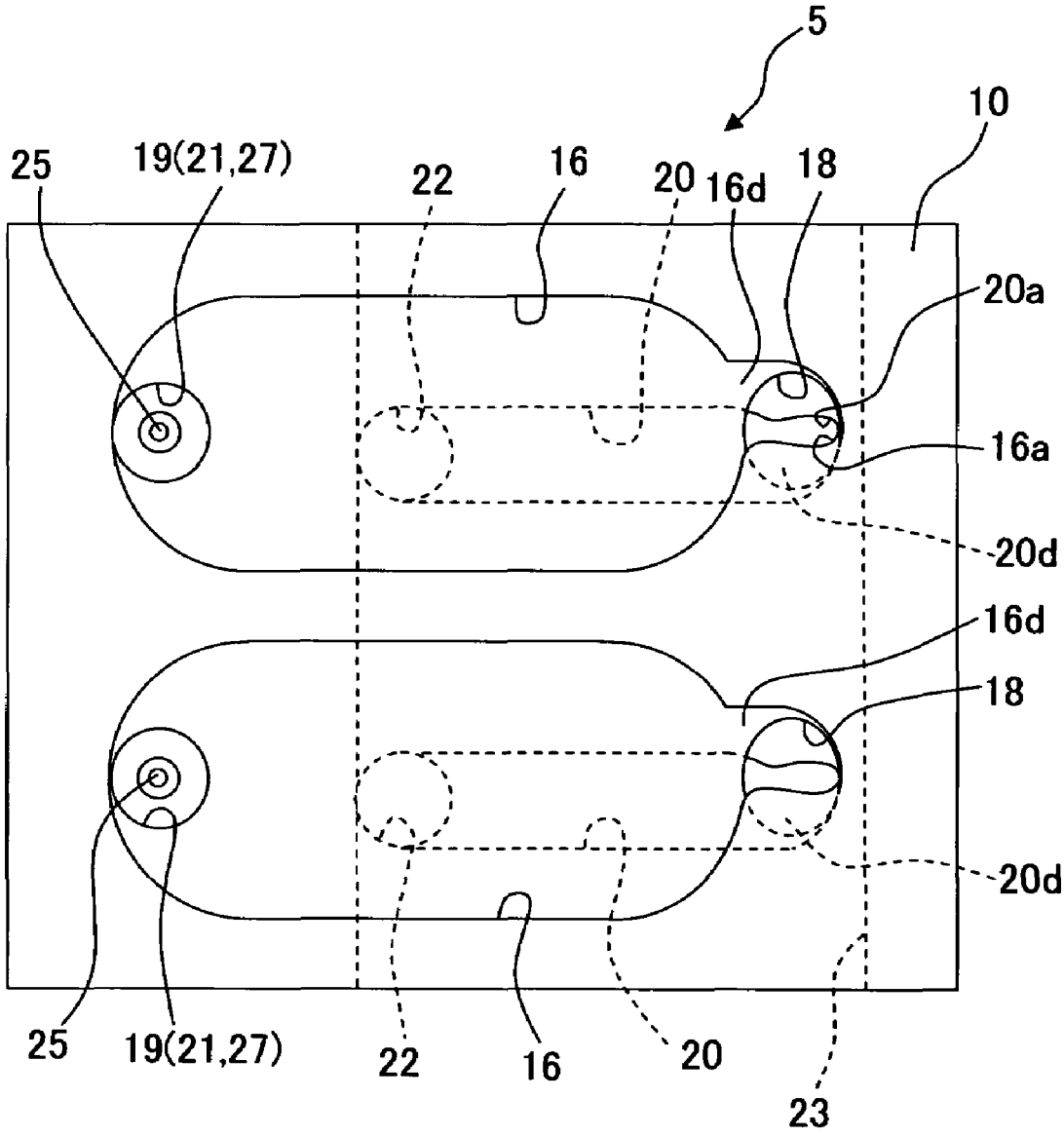
FIG. 5 is a view of a channel unit as viewed from an upper surface of a cavity plate.
Figure 6:
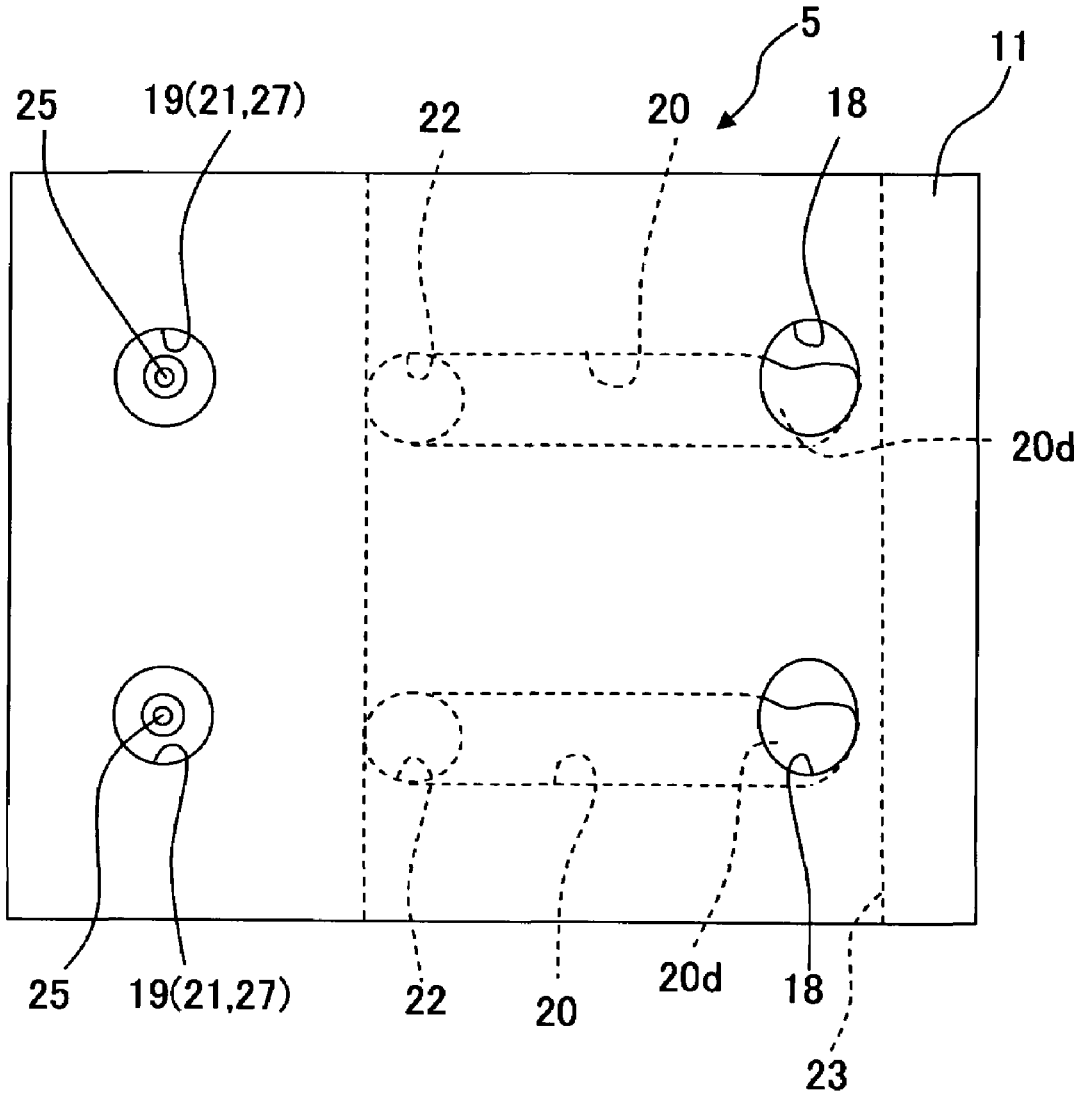
FIG. 6 is a view of the channel unit as viewed from an upper surface of a base plate.
Figure 7A:
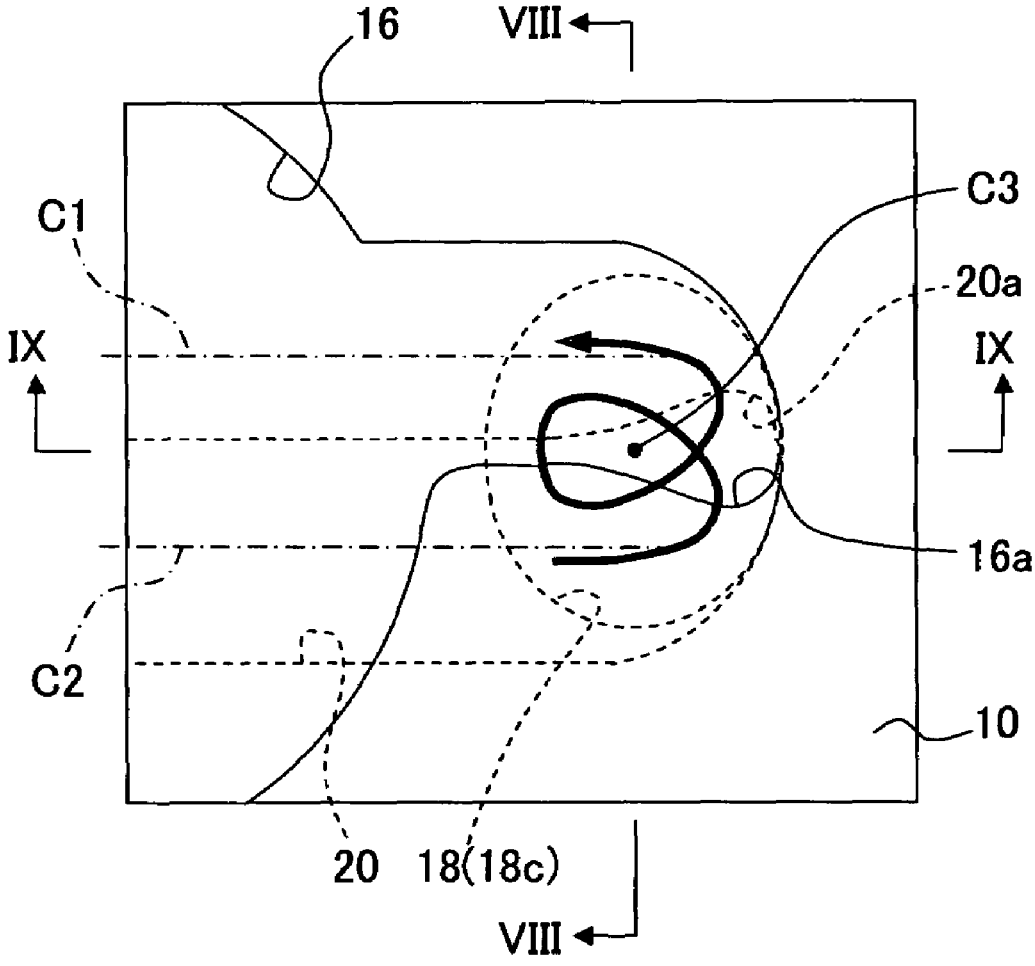
FIG. 7A is an enlarged view of the vicinity of a communication hole in FIG. 5.
Figure 7B:
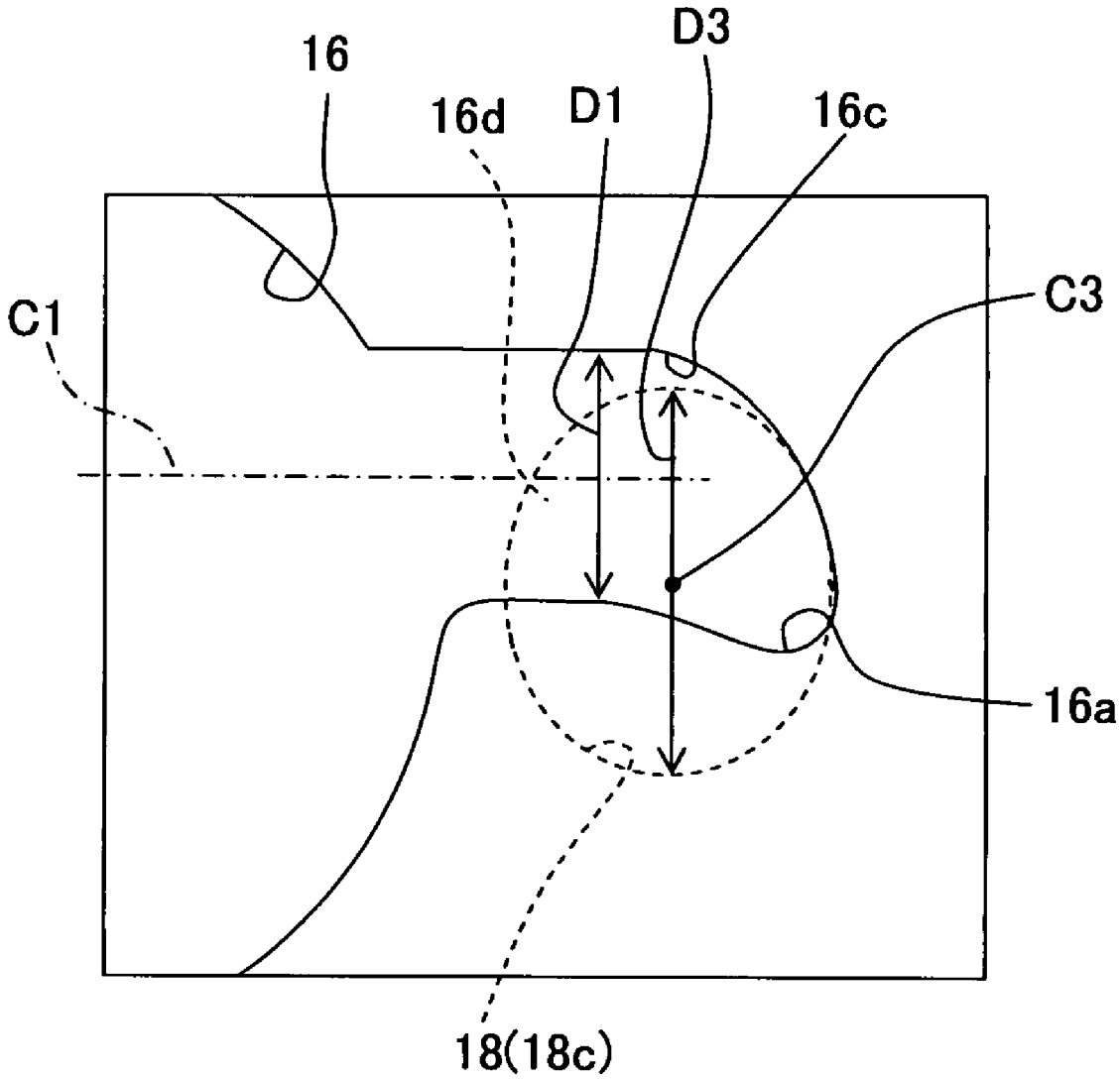
FIG. 7B is a view showing an arrangement relation of the communication hole and a pressure chamber in FIG. 7A.
Figure 7C:
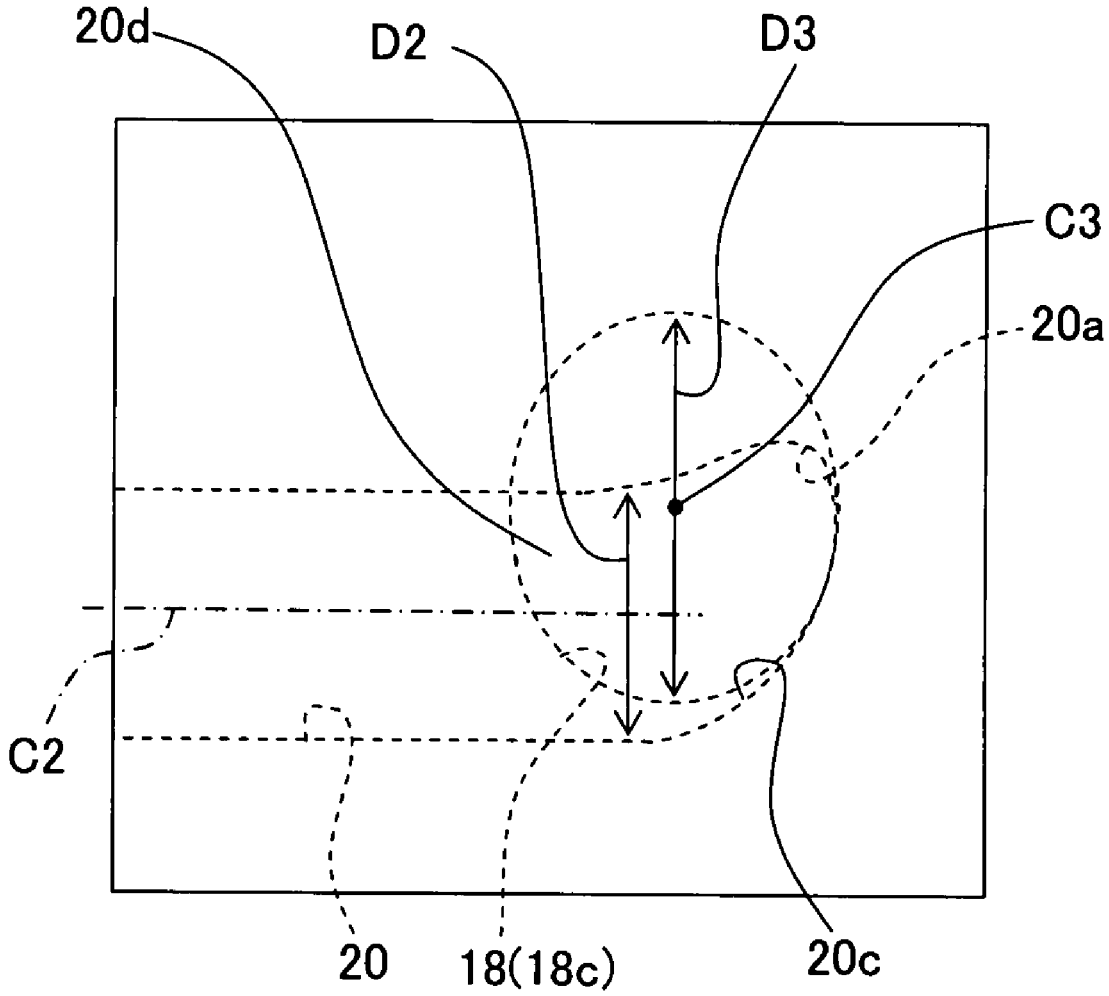
FIG. 7C is a view showing an arrangement relation of a throttle channel and the communication hole in FIG. 7A.
Figure 7D:
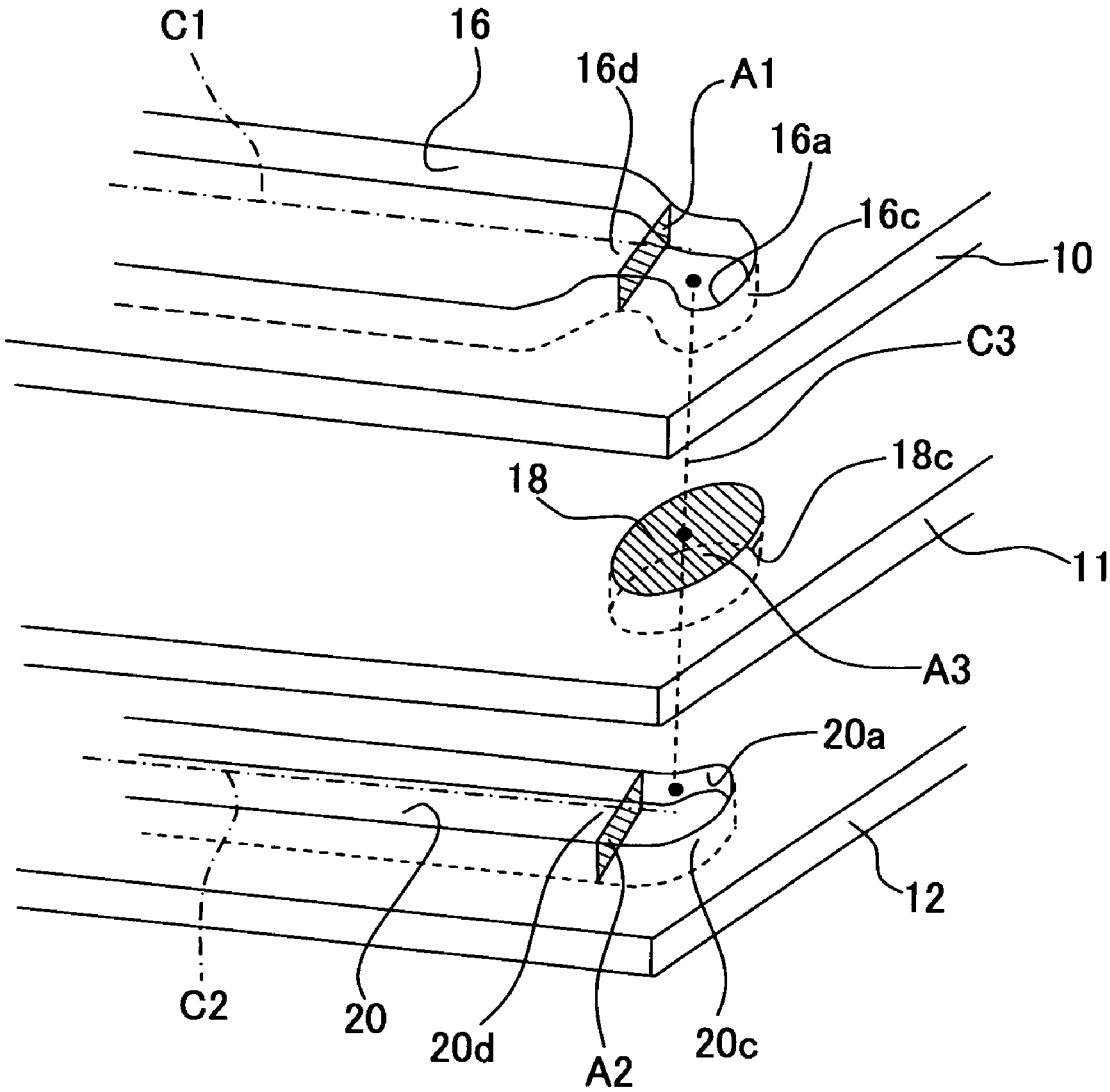
FIG. 7D is an exploded perspective view three-dimensionally showing the arrangement relation of the pressure chamber 16, the communication hole 18, and the throttle channel 20.
Figure 8:
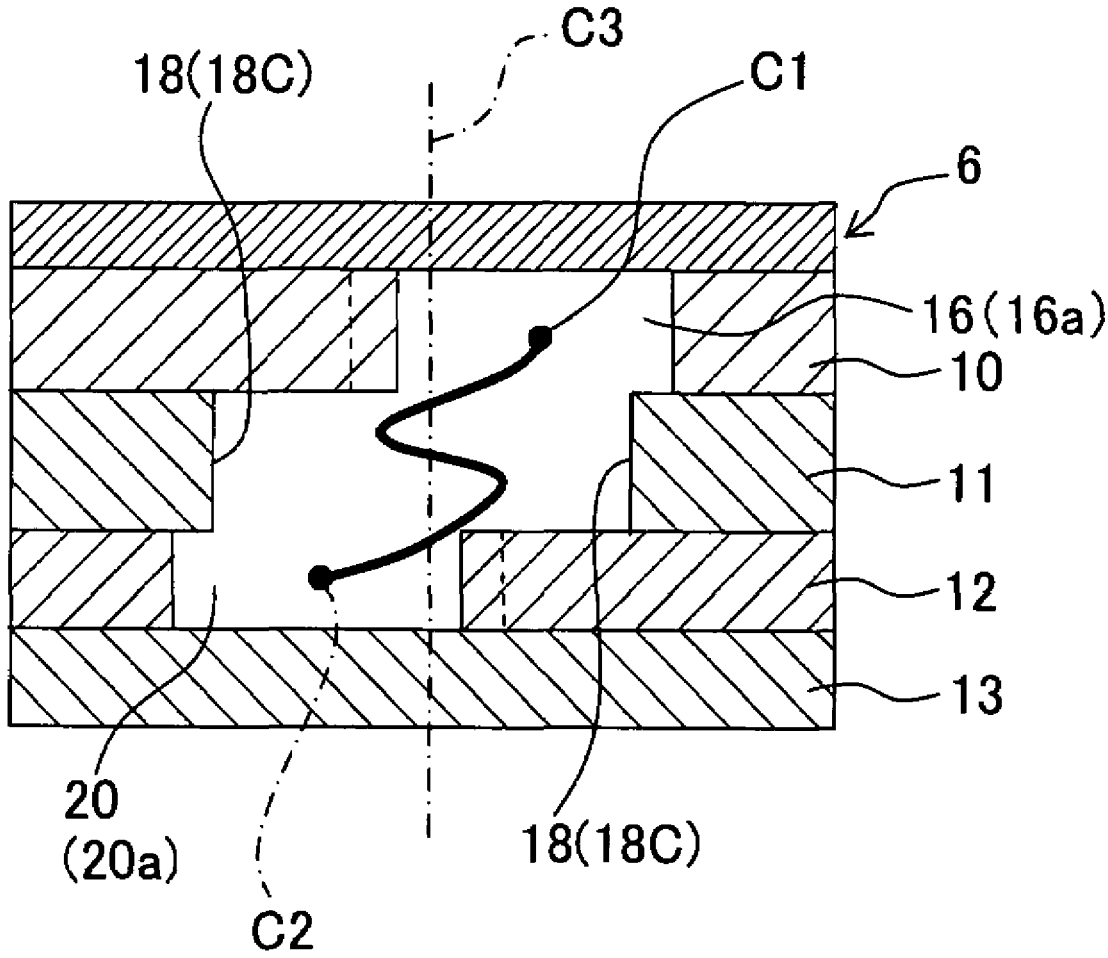
FIG. 8 is a cross-sectional view taken along line VIII-VIII in FIG. 7A.
Figure 9:
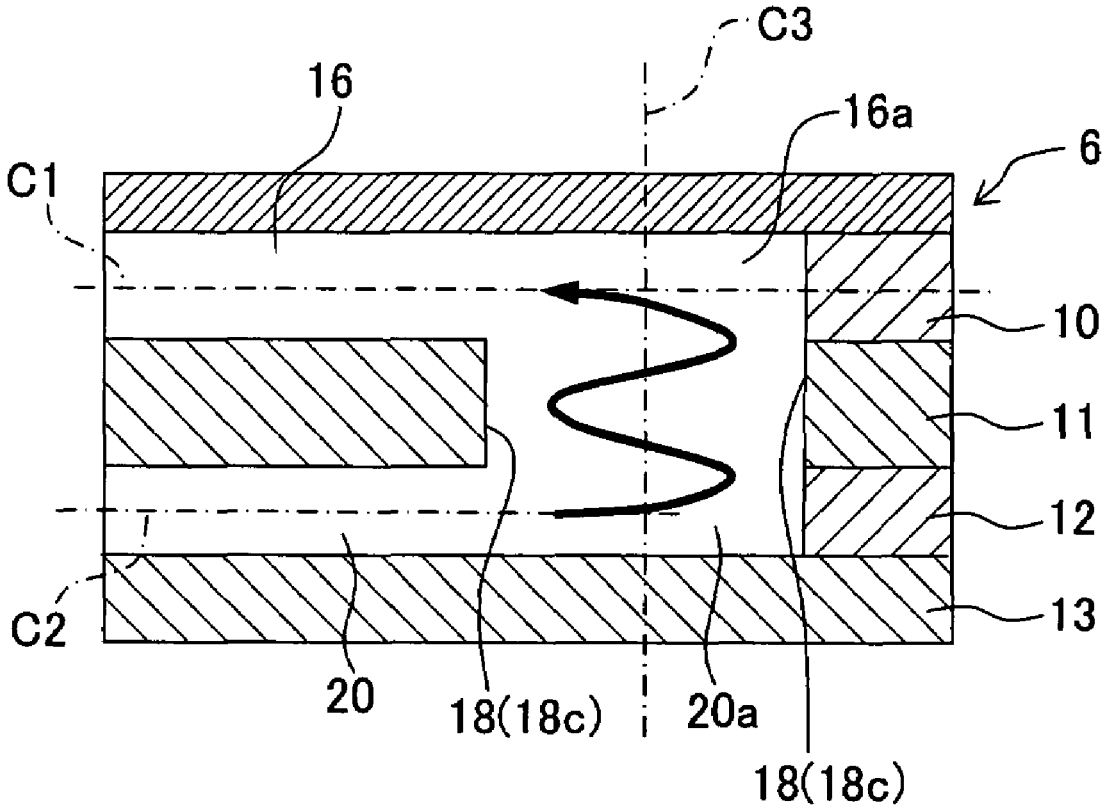
FIG. 9 is a cross-sectional view taken along line IX-IX in FIG. 7A.

In view of the above, the ink channel 26 of this embodiment further includes a structure which is capable of preventing bubbles from staying in the folded portion of the channel. FIG. 7A is an enlarged view of the vicinity of the communication hole 18 in FIG. 5 and is a view showing an arrangement relation of the pressure chamber 16, the communication hole 18, and the throttle channel 20 as viewed from an upper surface of the cavity plate 10. FIG. 7B is a view with the throttle channel 20 in FIG. 7A being excluded in order to explain an arrangement relation of the pressure chamber 16 and the communication hole 18. FIG. 7C is a view with the pressure chamber 16 in FIG. 7A being excluded in order to explain an arrangement relation of the communication hole 18 and the throttle channel 20. FIG. 7D is an exploded perspective view three-dimensionally showing the arrangement relation of the pressure chamber 16, the communication hole 18, and the throttle channel 20. Further, FIG. 8 is a view showing the arrangement relation of the pressure chamber 16, the communication hole 18, and the throttle channel 20 as viewed from a cross section taken along line VIII-VIII in FIG. 7A. FIG. 9 is a view showing the arrangement relation of the pressure chamber 16, the communication hole 18, and the throttle channel 20 as viewed from a cross section taken along line IX-IX in FIG. 7A.

As shown in FIG. 7B and FIG. 8, a center line C3 of the communication hole 18 (line passing through a center of a cross section of the communication hole 18 and extending in a direction in which the communication hole 18 extends) deviates from a center line C1 of the pressure chamber 16 (line passing through a center of a cross section of the pressure chamber 16 and extending in a direction in which the pressure chamber 16 extends), in a width direction of the pressure chamber 16 (direction orthogonal to the center line C1) in a plan view (as viewed from a direction orthogonal to the plate surface). As shown in FIG. 7B, the communication hole 18 is substantially circular (elliptical) as viewed from the upper surface of the base plate 11, and a diameter D3 of the communication hole 18 is larger than a width D1 of the pressure chamber 16 at the end portion 16*d* thereof. As for a channel area, as shown in FIG. 7D, the channel area A3 of the communication hole 18 is larger than the channel area A1 of the pressure chamber 16 at the end portion 16*d* thereof. That is, the ink flows from the communication hole 18 with a larger channel area into the pressure chamber 16 with a smaller channel area whose center line C1 deviates in the width direction of the pressure chamber 16 from the center line C3 of the communication hole 18. Owing to such dimensions (the channel areas and the diameters) and arrangement relation of the pressure chamber 16 and the communication hole 18, a swirling flow as shown by the heavy line in FIG. 7A, FIG. 8, and FIG. 9, that is, a swirling flow flowing in the communication hole 18 in a circumferential direction along a side surface of the communication hole 18 to flow into the pressure chamber 16 is generated in the connection portion 16*a* at which the pressure chamber 16 is connected to the communication hole 18, and this swirling flow prevents bubbles from staying in the connection portion 16*a*.

Further, as shown in FIG. 7C and FIG. 8, the center line C3 of the communication hole 18 also deviates from a center line C2 of the throttle channel 20 (line passing through a center of a cross section of the throttle channel 20 and extending in a direction in which the throttle channel 20 extends) in a width direction of the throttle channel 20 (direction orthogonal to the center line C2) in a plan view. As shown in FIG. 7C, the diameter D3 of the communication hole 18 is larger than a width D2 of the throttle channel 20 at the end portion 20*d* thereof. As for a channel area, as shown in FIG. 7D, the channel area A3 of the communication hole 18 is larger than the channel area A2 of the throttle channel 20 at the end portion 20*d* thereof. That is, the ink flows from the throttle channel 20 with a smaller channel area into the communication hole 18 with a larger channel area whose center line C3 deviates in the width direction of the throttle channel 20 from the center line C2 of the throttle channel 20. Owing to such dimensions (the channel areas and the diameters) and arrangement relation of the communication hole 18 and the throttle channel 20, a swirling flow as shown by the heavy line in FIG. 7A, FIG. 8, and FIG. 9, that is, a swirling flow flowing from the throttle channel 20 to the communication hole 18 and flowing in the communication hole 18 in the circumferential direction along the side surface of the communication hole 18 is generated in the connection portion 20*a* at which the throttle channel 20 is connected to the communication hole 18, and the swirling flow prevents bubbles from staying in the connection portion 20*a*.

That is, the center line C3 of the communication hole 18 deviates from at least one of the center line C1 of the pressure chamber 16 and the center line C2 of the throttle channel 20 in the width direction of the pressure chamber 16 or the throttle channel 20 as viewed from the direction orthogonal to the plate. Further, the channel area A3 of the communication hole 18 is larger than both of the channel area A1 of the pressure chamber 16 at the end portion 16*d* thereof and the channel area A2 of the throttle channel 20 at the end portion 20*d* thereof. Consequently, the swirling flow is generated in the folded portion of the ink channel 26, which makes it possible to prevent bubbles from staying.

As shown in FIG. 7A, the center line C3 of the communication hole 18 is positioned between the center line C1 of the pressure chamber 16 and the center line C2 of the throttle channel 20. In this case, the ink flowing into the pressure chamber 16 from the throttle channel 20 via the communication hole 18 flows more smoothly than in a case where both of the center line C1 of the pressure chamber 16 and the center line C2 of the throttle channel 20 are positioned on the same side with respect to the center line C3 of the communication hole 18. Therefore, bubbles are more difficult to stay in the communication hole 18.

Further, as shown in FIG. 5 to FIG. 9, the communication hole 18 has a cylindrical shape whose cross section as viewed from the upper surface of the base plate 11 is substantially circular, and as shown in FIG. 7B, in the pressure chamber 16, one sidewall 16*c* at the end portion 16*d* is curved along a sidewall 18*c* of the communication hole 18, and the connection portion 16*a* connected to the communication hole 18 bends toward the center of the communication hole 18, in a plan view. Further, as shown in FIG. 7C, in the throttle channel 20, a sidewall 20*c* at the end portion 20*d* is curved along the sidewall 18*c* of the communication hole 18, and the connection portion 20*a* connected to the communication hole 18 is bent toward the center of the communication hole 18, in a plan view. Therefore, in the connection portions 16*a*, 20*a* at which the pressure chamber 16 and the throttle channel 20 are connected to the communication hole 18, the ink is led along the sidewall 18*c* of the communication hole 18, which ensures the generation of the swirling flow.

As has been explained hitherto, the channel unit 5 includes the ink channels 26 having the liquid channel structure of the present invention in order to more surely prevent bubbles from staying.

Next, the piezoelectric actuator 6 will be explained. As shown in FIG. 2 to FIG. 4, the piezoelectric actuator 6 includes a plurality of piezoelectric layers 31 staked on the upper surface of the channel unit 5 and individual electrodes 32 and common electrodes 34 arranged between the plural piezoelectric layers 31.

The piezoelectric layers 31 are made of a piezoelectric material whose major component is lead zirconate titanate (PZT) which is a solid solution of lead titanate and lead zirconate and which is a ferroelectric, and these piezoelectric layers 31 have undergone polarization processing in a thickness direction. Further, the piezoelectric layers 31 are continuously disposed on the upper surface of the cavity plate 10 to cover the pressure chambers 16. To form the piezoelectric layers 31, for example, piezoelectric sheets obtained by burning green sheets of PZT are pasted on the cavity plate 10.

The individual electrodes 32 and the common electrodes 34 are alternately arranged between the piezoelectric layers 31 except some of upper-side ones among the piezoelectric layers 31. The individual electrodes 32 and the common electrodes 34 are both made of a conductive material such as gold, copper, silver, palladium, platinum, titanium, or the like.

The individual electrodes 32 have a substantially elliptical plane shape which is slightly smaller than the pressure chambers 16, and are arranged at positions overlapping with centers of the pressure chambers 16 in a plan view. As shown in FIG. 2 and FIG. 3, wirings 35 are led out from the respective individual electrodes 32 in a longitudinal direction of the individual electrodes 32. The individual electrodes 32 are connected to a driving circuit (not shown) via the wirings 35, and a predetermined driving voltage is applied from the driving circuit to each of the individual electrodes 32.

The common electrodes 34 are arranged continuously to cover the pressure chambers 16. Therefore, in each of the areas overlapping with the centers of the pressure chambers 16, each of the piezoelectric layers 31 is sandwiched between the individual electrode 32 and the common electrode 34. The common electrodes 34 are grounded at a not-shown position to be constantly kept at a ground potential.

Next, the operation of the piezoelectric actuator 6 when the ink is jetted will be explained. When the driving voltage is applied from the driving circuit to the individual electrodes 32 corresponding to one of the pressure chambers 16, a potential difference occurs between the individual electrodes 32 and the common electrodes 34 kept at the ground potential. At this time, an electric field in the thickness direction which is the polarization direction of the piezoelectric layers 31 is generated in the piezoelectric layers 31 each sandwiched between the individual electrode 32 and the common electrode 34, and consequently, the piezoelectric layers 31 expand in the thickness direction due to a vertical piezoelectric effect. Consequently, since a volume in the pressure chamber 16 decreases, the pressure is applied to the ink in the pressure chamber 16 and droplets of the ink are jetted from the nozzle 25 communicating with the pressure chamber 16. When this piezoelectric actuator 6 is driven, each of the piezoelectric layers 31 expands in the thickness direction, which makes it possible to apply a large pressure to the ink in the pressure chamber 16 by one driving.

As explained above, in the ink-jet head 1, the center line C3 of the communication hole 18 (communication channel) which communicates the pressure chamber 16 (first channel) at the end portion 16*d* thereof and the throttle channel 20 (second channel) at the end portion 20*d* thereof respectively formed in the different plates 10, 12 deviates from at least one of the center line C1 of the pressure chamber 16 and the center line C2 of the throttle channel 20 in the width direction of the channel. That is, the line C3 passing through the center of the cross section of the communication hole 18 and extending in the direction in which the communication hole 18 extends deviates from at least one of the line C1 passing through the center of the cross section of the pressure chamber 16 and extending in the direction in which the pressure chamber 16 extends and the line C2 passing through the center of the cross section of the throttle channel 20 and extending in the direction in which the throttle channel 20 extends, in the width direction of the pressure chamber 16 or the throttle channel 20. Further, the channel area A3 of the communication hole 18 is larger than the channel area A1 of the pressure chamber 16 at the end portion 16*d* thereof and the channel area A2 of the throttle channel 20 at the end portion 20*d* thereof. Therefore, swirling flows are generated both in the connection portion 16*a* at which the pressure chamber 16 is connected to the communication hole 18 and in the connection portion 20*a* at which the throttle channel 20 is connected to the communication hole 18. The swirling flows prevent bubbles from staying in the connection portions 16*a*, 20*a*.

Therefore, the bubbles do not easily stay in the ink channel 26 even if the structure to secure the sufficient length of the throttle channel 20 yet make the ink channel 26 compact to reduce the size of the channel unit 5 is adopted, specifically, even if the flow directions of the ink in the pressure chamber 16 and in the throttle channel 20 are made substantially opposite to each other and the ink channel 26 is folded back at the communication hole 18. Furthermore, even if bubbles stay in the ink channel 26, the bubbles can be easily discharged by purging. Therefore, it is possible to decrease the number of times the purging is performed, thereby reducing a discharge amount of the ink.

Next, modifications in which the above-described embodiment is variously changed will be explained. The same reference numerals and symbols are assigned to components having the same structure as the components of the above-described embodiment, and explanation thereof will be omitted when appropriate.

First Modification

Figure 10:
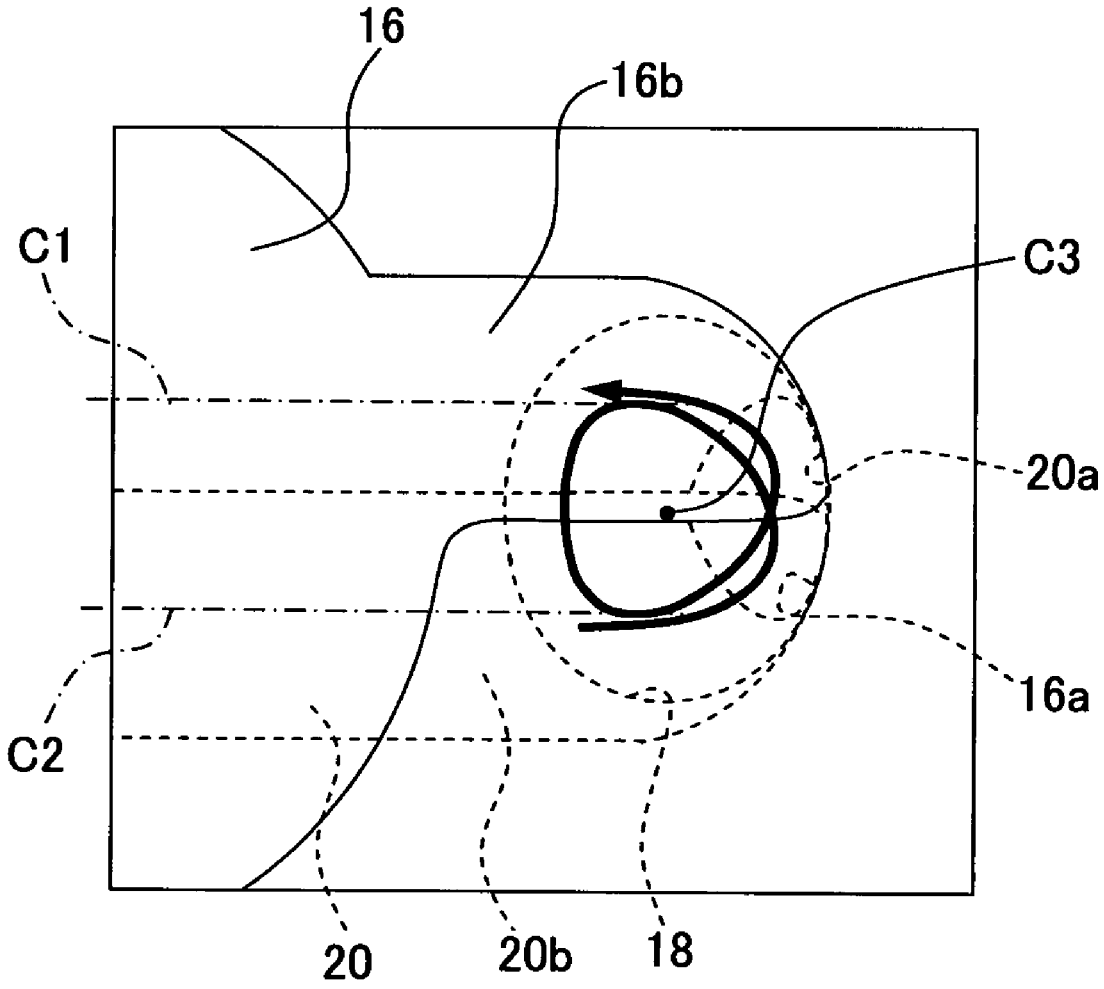
FIG. 10 is an enlarged view corresponding to FIG. 7A, according to a first modification.
Figure 11A:
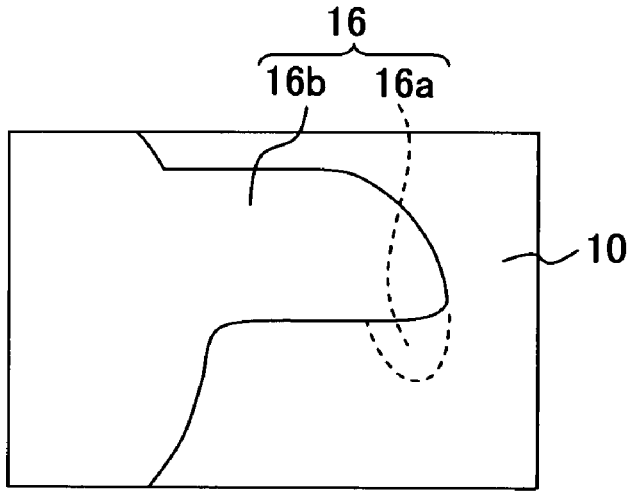
FIG. 11A is a plan view of a cavity plate according to the first modification.
Figure 11B:
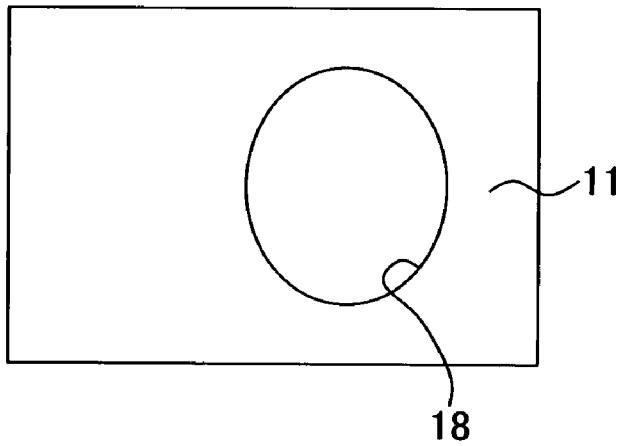
FIG. 11B is a plan view of a base plate according to the first modification.
Figure 11C:
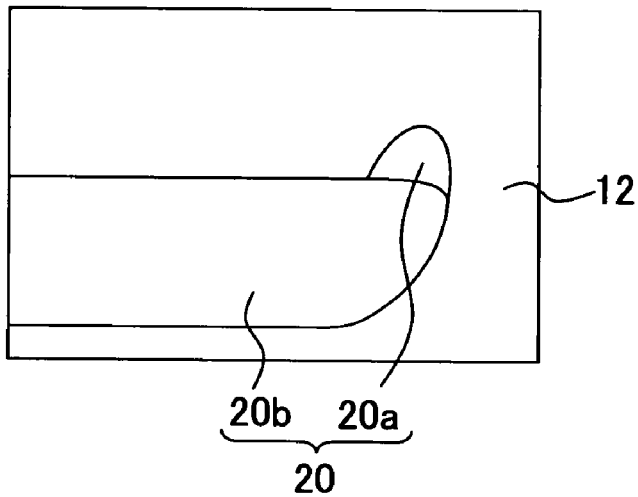
FIG. 11C is a plan view of a throttle plate according to the first modification.

In a first modification shown in FIG. 10 and FIG. 11, main channels 16*b*, 20*b* (portions except the connection portions 16*a*, 20*a* connected to the communication hole 18) of the pressure chamber 16 and the throttle channel 20 are formed of through holes penetrating the cavity plate 10 and the throttle plate 12 respectively. On the other hand, the connection portions 16*a*, 20*a* at which the both channels 16, 20 are connected to the communication hole 18 and which bend toward the center of the communication hole 18 are defined by recess which are formed by half etching or the like in the cavity plate 10 and the throttle plate 12 on surfaces on a side of the base plate 11 (in FIG. 11A, a far-side surface in the drawing and in FIG. 11C, a near-side surface in the drawing). According to this structure, ink is led along the wall surface of the communication hole 18 by the connection portions 16*a*, 20*a* which are positioned between the communication hole 18 and the main channels 16*b*, 20*b* of the pressure chamber 16 and the throttle channel 20 formed of the through holes and which are defined by the recesses. Consequently, swirling flows are more surely generated in the connection portions 16*a*, 20*a*.

Second Modification

Figure 12:
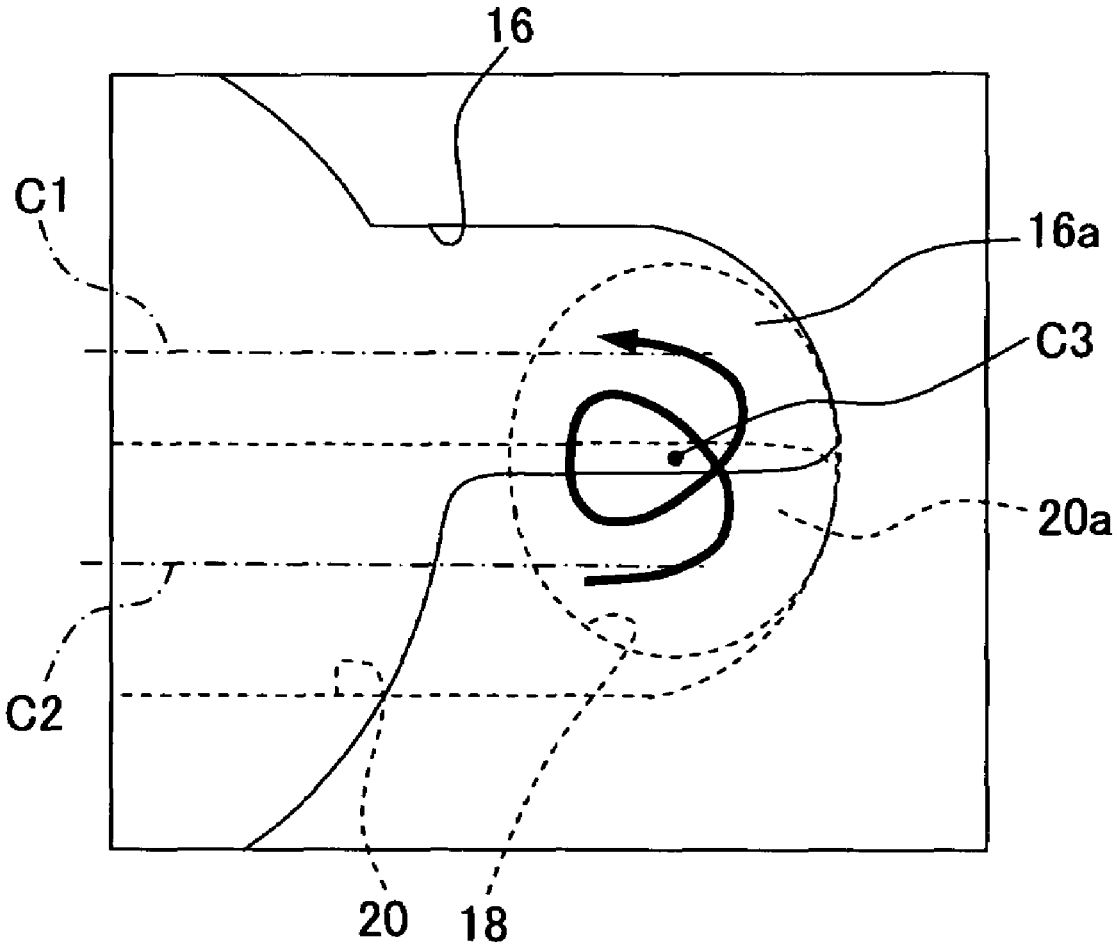
FIG. 12 is an enlarged view corresponding to FIG. 7A, according to a second modification.
Figure 13:
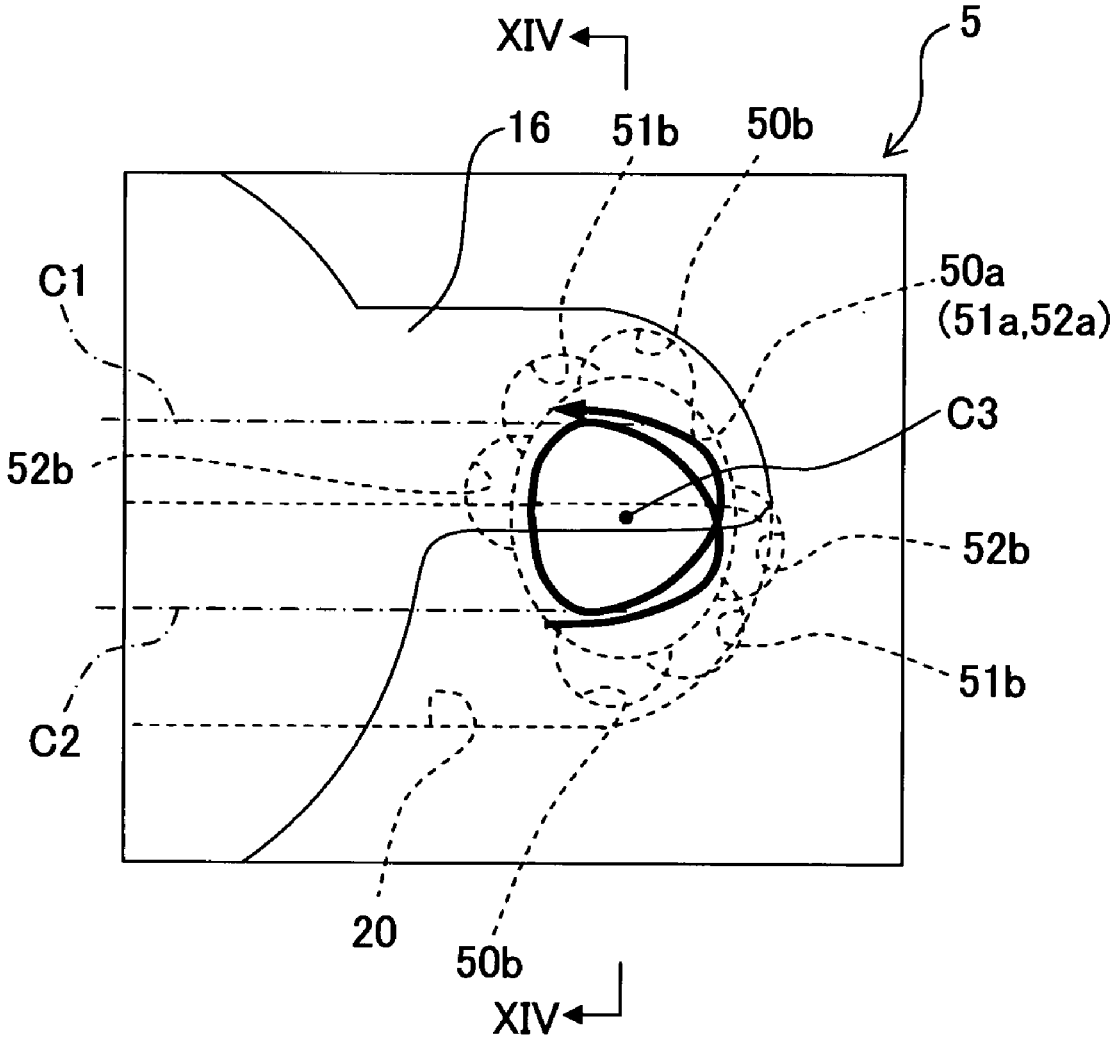
FIG. 13 is an enlarged view corresponding to FIG. 7A, according to a third modification.
Figure 14:
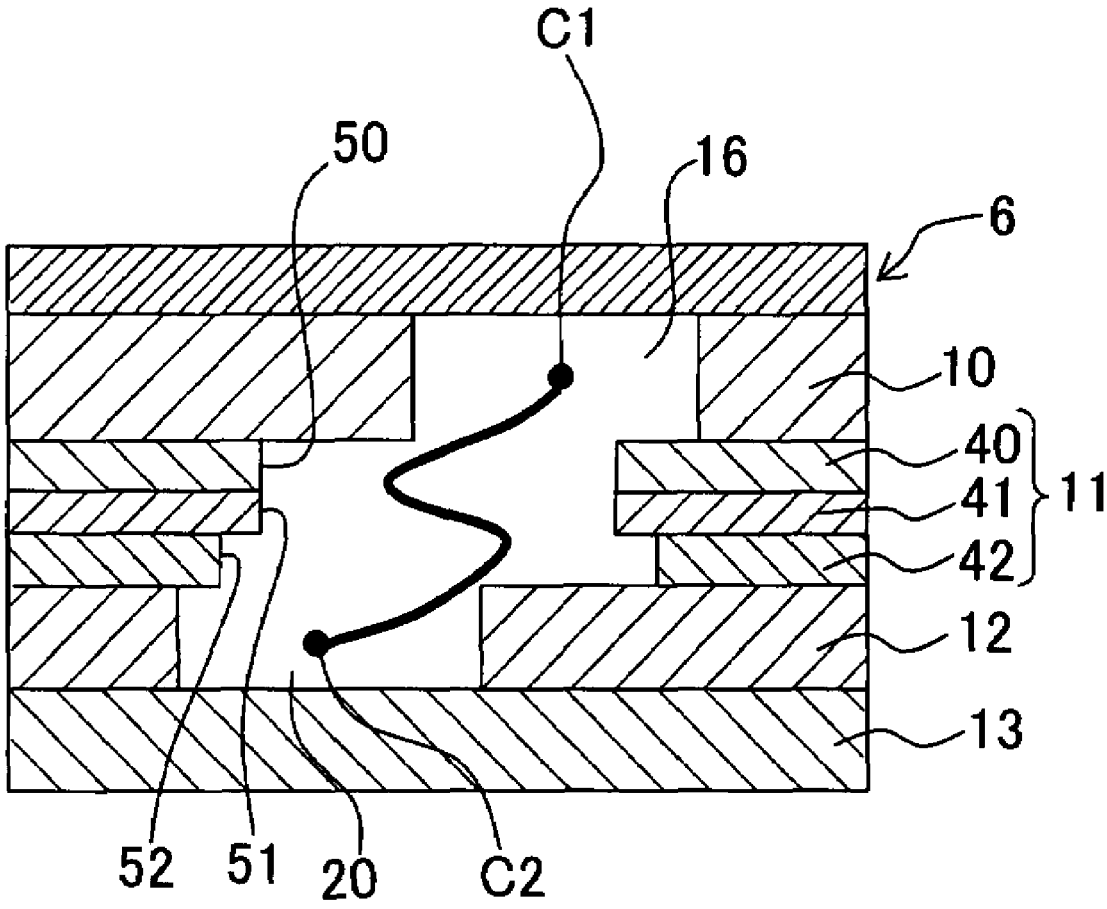
FIG. 14 is a cross-sectional view taken along line XIV-XIV in FIG. 13.

In the above-described embodiment, both of the connection portion 16*a* at which the pressure chamber 16 is connected to the communication hole 18 and the connection portion 20*a* at which the throttle channel 20 is connected to the communication hole 18 are bent toward the center of the communication hole 18. However, the effect of generating a swirling flow can be obtained even if the connection portions 16*a*, 20*a* are not bent toward the center of the communication hole 18 as shown in FIG. 12.

Third Modification

In a case where a communication channel which communicates the pressure chamber 16 and the throttle channel 20 is formed across a plurality of plates, a structure in which a swirling flow is also generated in this communication channel is preferable. For example, as shown in FIG. 13 to FIG. 16, the channel unit 5 includes the cavity plate 10 in which the pressure chambers 16 are formed, the throttle plate 12 in which the throttle channels 20 are formed, and three base plates (a first base plate 40, a second base plate 41, and a third base plate 42 (communication channel plates)) disposed between the cavity plate 10 and the throttle plate 12.

Figure 15A:
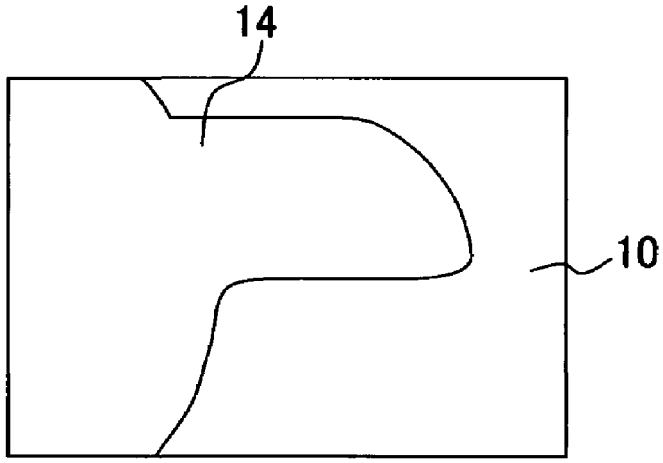
FIG. 15A is a plan view of a cavity plate according to the third modification.
Figure 15B:
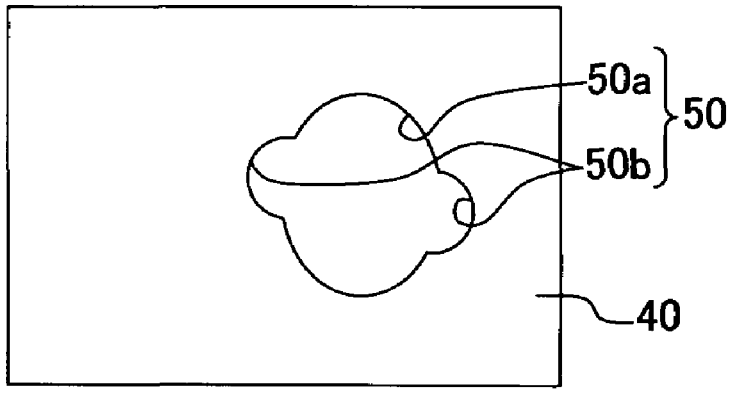
FIG. 15B is a plan view of a first base plate according to the third modification.
Figure 15C:
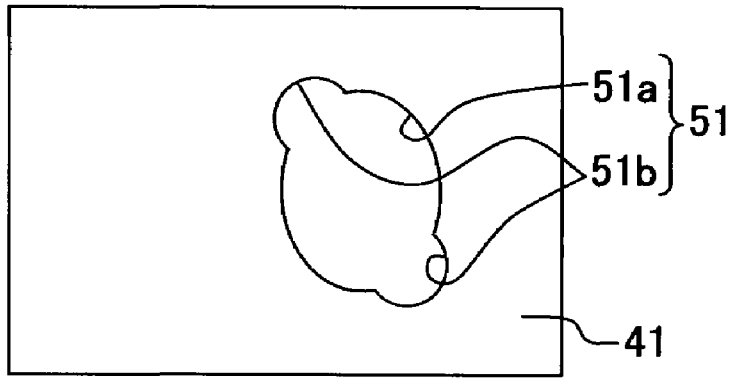
FIG. 15C is a plan view of a second base plate according to the third modification.
Figure 16A:
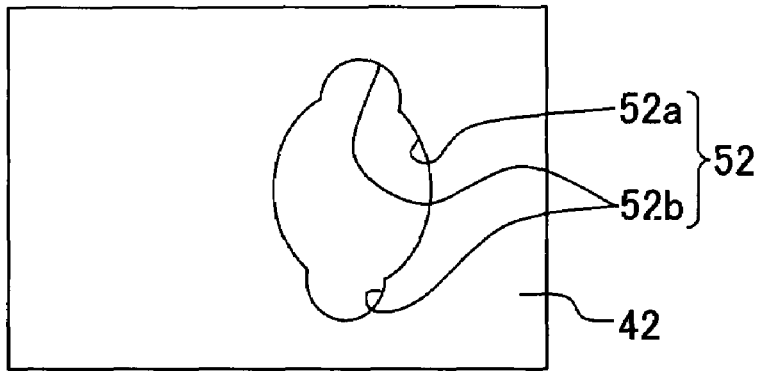
FIG. 16A is a plan view of a third base plate according to the third modification.
Figure 16B:
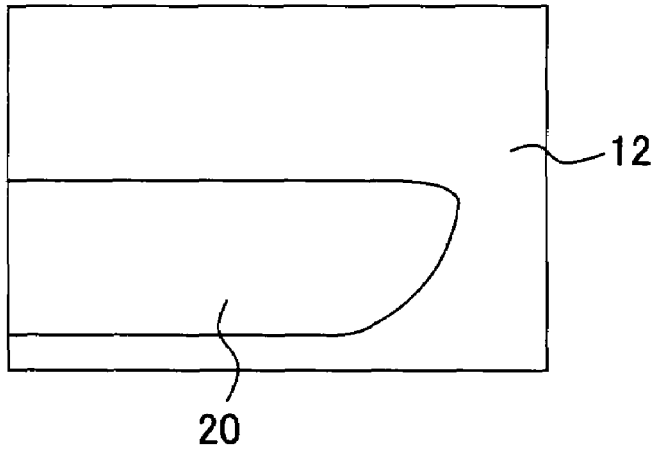
FIG. 16B is a plan view of a throttle plate according to the third modification.

In the three base plates 40, 41, 42, three communication holes 50, 51, 52 forming the communication channel which communicates the pressure chamber 16 and the throttle channel 20 are formed respectively. Each of the three communication holes 50, 51, 52 is composed of a center hole 50*a* (51*a*, 52*a*) having a substantially circular plane shape and a pair of notches 50*b* (51*b*, 52*b*) which are made by outwardly cutting from the center hole 50*a* (51*a*, 52*a*) in a diameter direction. The center holes 50*a*, 51*a*, 52*a* are arranged, with the centers thereof coinciding with the center line C3 of the communication channel. Further, as shown in FIG. 15B, the two notches 50*b* are arranged at positions symmetrical with respect to the center of the substantially circular center hole 50*a*, that is, the center line C3 of the communication channel. Further, as shown in FIG. 15C, the two notches 51*b* are arranged at positions symmetrical with respect to the center of the center hole 51*a*, and as shown in FIG. 16A, the two notches 52*b* are arranged at positions symmetrical with respect to the center of the center hole 52*a*.

The notches 50*b*, 51*b*, 52*b* are arranged to deviate from one another by a predetermined angle (for example, 45 degrees) in a circumferential direction of the three communication holes 50, 51, 52. That is, the three center holes 50*a*, 51*a*, 52*a* are arranged to overlap with one another, but the notches 50*b*, 51*b*, 52*b* are arranged to deviate from one another in sequence by the predetermined angle in the circumferential direction while partly overlapping with the notches of the other communication holes 50, 51, 52 adjacent in the plate stacking direction. Therefore, the communication channel includes an area formed by the center holes 50*a*, 51*a*, 52*a* arranged to completely overlap with one another (overlapping area) and areas formed by the notches 50*b*, 51*b*, 52*b* arranged spirally so as not to completely overlap with one another (spiral areas). A mainstream of the ink from the throttle channel 20 toward the pressure chamber 16 flows in the overlapping area. On the other hand, tributary streams of the ink flowing around the mainstream flow in the spiral areas. Therefore, in the communication channel formed of the three communication holes 50, 51, 52, the mainstream of the ink flows smoothly in the overlapping area. On the other hand, since the tributary streams of the ink flow as swirling flows in the vicinity of the wall surfaces of the communication holes 50, 51, 52 toward the pressure chamber 16, it is possible to surely prevent bubbles from staying in the communication channel.

Fourth Modification

In the above-described embodiment, the center line C3 of the communication hole 18 deviates from both of the center lines C1, C2 of the pressure chamber 16 and the throttle channel 20 in the width direction of these channels, but the center line C3 may deviate from the center line of only one channel out of the pressure chamber 16 and the throttle channel 20. In this case, since a swirling flow is also generated in the connection portion at which the one channel is connected to the communication hole 18, bubbles are prevented from staying.

Fifth Modification

In the above-described embodiment and its modifications, the swirling flow is generated between the pressure chamber 16 as the first channel and the throttle channel 20 as the second channel, but the same structure is adoptable also in other portions of the ink channel in the channel unit, such as a portion between the manifold 23 and the throttle channel 20.

The above-described embodiment and its modifications are examples where the present invention is applied to the ink-jet head which jets ink from the nozzles, but the application of the present invention is not limited to the ink-jet head. For example, the present invention is also applicable to various apparatuses having a liquid channel structure in which liquid other than ink flows, such as a micro total analysis system (μTAS) having a liquid channel in which a chemical solution, a biochemical solution, or the like flows, and a micro chemical analysis system having a liquid channel in which liquid such as a solvent or a chemical solution flows.

What is claimed is:

1. A liquid channel structure, comprising:

a first channel which extends along a first plane and in which liquid flows;

a second channel which extends along a second plane different from the first plane and in which the liquid flows; and a communication channel which communicates the first channel at an end portion thereof and the second channel at an end portion thereof;

wherein a center line of the communication channel deviates from a center line of at least one of the first and second channels in a width direction of one of the first and second channels; and a channel area of the communication channel is larger than a channel area of the first channel at the end portion thereof and a channel area of the second channel at the end portion thereof.

2. The liquid channel structure according to claim 1, wherein the center line of the communication channel deviates from both of the first channel and the second channel in the width direction of the first and second channels.

3. The liquid channel structure according to claim 1, wherein the channel area of the communication channel is larger than a channel area, of one of the first and second channels which is positioned on a downstream in a flow direction of the liquid, at the end portion thereof.

4. The liquid channel structure according to claim 1, wherein a connection portion at which one of the first and second channels is connected to the communication channel is bent toward a center of the communication channel.

5. The liquid channel structure according to claim 1, wherein the liquid flows in the first channel and the second channel in mutually opposite directions, and the center line of the communication channel is positioned between the center line of the first channel and the center line of the second channel.

6. The liquid channel structure according to claim 1, wherein the communication channel has a cylindrical form, the end portion of the first channel is connected to one end portion of the communication channel;

the end portion of the second channel is connected to the other end portion of the communication channel; and a sidewall of the first channel is curved, at the end portion of the first channel, along a sidewall of the communication channel, and a sidewall of the second channel is curved, at the end portion of the second channel, along the sidewall of the communication channel.

7. The liquid channel structure according to claim 1, wherein the first plane is parallel to the second plane.

8. A liquid-droplet jetting apparatus which jets a liquid droplet of a liquid from a nozzle, comprising:

a channel unit which has a liquid channel communicating with the nozzle; and a jetting pressure applying mechanism which applies a jetting pressure to the liquid in the liquid channel, wherein the liquid channel includes a first channel which extends along a first plane and in which the liquid flows, a second channel which extends along a second plane different from the first plane and in which the liquid flows, and a communication channel which communicates the first channel at an end portion thereof and the second channel at an end portion thereof;

a center line of the communication channel deviates from a center line of at least one of the first and second channels in a width direction of one of the first and second channels; and a channel area of the communication channel is larger than a channel area of the first channel at the end portion thereof and a channel area of the second channel at the end portion thereof.

9. The liquid-droplet jetting apparatus according to claim 8, wherein the liquid flows in the first channel and the second channel in mutually opposite directions, and the center line of the communication channel is positioned between the center line of the first channel and the center line of the second channel.

10. The liquid-droplet jetting apparatus according to claim 8, wherein the channel unit has a structure in which a plurality of stacked plates each having a part of the liquid channel formed therein;

the first channel is formed in a first plate included in the plates, and the second channel is formed in a second plate included in the plates and different from the first plate; and the communication channel is formed in a third plate included in the plates and different from the first plate and the second plate, and the third plate is arranged between the first plate and the second plate.

11. The liquid-droplet jetting apparatus according to claim 10, wherein a connection portion, at which one of the first and second channels is connected to the communication channel, is bent toward a center of the communication channel; a through hole defining a portion other than the connection portion of one of the first and second channels is formed in one of the first plate and the second plate; and the connection portion of one of the first and second channels is defined by a recess formed in a surface of one of the first and second plates, the surface being on a side of the third plate.

12. The liquid-droplet jetting apparatus according to claim 8, wherein the third plate further includes a plurality of communication channel plates stacked on each other in a stacking direction, communication holes each forming a part of the communication channel are formed in the communication channel plates respectively;

each of the communication holes has a substantially circular center hole and a notch positioned outside the center hole; and the communication channel includes an overlap area formed of a center hole of a communication channel plate among the communication channel plates overlapping with a center hole in another communication channel plate among the communication channel plates, and a spiral area formed of a notch in the communication channel plate partly overlapping, in a circumferential direction of the center hole in the communication channel plate, with a notch in another communication channel plate, among the communication channel plates, which is adjacent in the stacking direction.

13. The liquid-droplet jetting apparatus according to claim 8, wherein a main stream of the liquid in the communication channel flows in the overlap area, and a tributary stream of the liquid flows in the spiral area.

14. The liquid-droplet jetting apparatus according to claim 8, wherein the liquid channel includes a common liquid chamber; a pressure chamber as the first channel which communicates with the nozzle, the jetting pressure being applied to the liquid in the pressure chamber by the jetting pressure applying mechanism; a throttle channel as the second channel which communicates with the common liquid chamber and has a channel area smaller than a channel area of the pressure chamber; and the communication channel which communicates the pressure chamber and the throttle channel; and the liquid channel is folded back at the communication channel between the throttle channel and the pressure chamber, and a flow direction in which the liquid flows in the throttle channel is substantially opposite to a flow direction in which the liquid flows in the pressure chamber.

15. The liquid-droplet jetting apparatus according to claim 14, wherein the communication channel has a cylindrical form;

the end portion of the pressure chamber is connected to one end portion of the communication channel;

the end portion of the throttle channel is connected to the other end portion of the communication channel; and a sidewall of the pressure chamber is curved, at the end portion of the pressure chamber, along a sidewall of the communication channel, and a sidewall of the throttle channel is curved, at the end portion of the throttle channel, along the sidewall of the communication channel.

16. The liquid-droplet jetting apparatus according to claim 8, wherein the first plane is parallel to the second plane.

* * * * *